US011179589B2

(12) United States Patent
Bayerlein et al.

(10) Patent No.: US 11,179,589 B2
(45) Date of Patent: Nov. 23, 2021

(54) TREADMILL WITH ELECTROMECHANICAL BRAKE

(71) Applicant: Woodway USA, Inc., Waukesha, WI (US)

(72) Inventors: Douglas G. Bayerlein, Oconomowoc, WI (US); Vance E. Emons, Hartland, WI (US); Nicholas Oblamski, Waukesha, WI (US)

(73) Assignee: Woodway USA, Inc., Waukesha, WI (US)

( * ) Notice: Subject to any disclaimer, the term of this patent is extended or adjusted under 35 U.S.C. 154(b) by 81 days.

(21) Appl. No.: 16/595,076

(22) Filed: Oct. 7, 2019

(65) Prior Publication Data

US 2020/0086157 A1 Mar. 19, 2020

Related U.S. Application Data

(63) Continuation of application No. 15/966,598, filed on Apr. 30, 2018, now Pat. No. 10,434,354, which is a (Continued)

(51) Int. Cl.
*A63B 21/005* (2006.01)
*A63B 22/00* (2006.01)
(Continued)

(52) U.S. Cl.
CPC ..... *A63B 21/0053* (2013.01); *A63B 21/0054* (2015.10); *A63B 21/0055* (2015.10);
(Continued)

(58) Field of Classification Search
CPC ..... A63B 22/02–0292
See application file for complete search history.

(56) References Cited

U.S. PATENT DOCUMENTS 8,308 A 8/1851 Seymour
26,914 A 1/1860 Meldrum
(Continued)

FOREIGN PATENT DOCUMENTS

CN 3201120 9/2001
CN 2860541 1/2007
(Continued)

OTHER PUBLICATIONS

U.S. Appl. No. 05/616,951, filed Sep. 26, 1975, Schonenberger.
(Continued)

*Primary Examiner* — Jennifer Robertson
(74) *Attorney, Agent, or Firm* — Foley & Lardner LLP

(57) ABSTRACT

A treadmill includes a treadmill frame having a front end and a rear end opposite the front end; a front running belt pulley coupled to the treadmill frame at or near the front end; a rear running belt pulley coupled to the treadmill frame at or near the rear end; a running belt disposed about the front and rear running belt pulleys, the running belt adapted for rotation about the front and rear running belt pulleys and defining a non-planar running surface; and a brake coupled to the running belt and adapted to selectively restrict the speed of rotation of the running belt depending upon an established limit for the speed of the running belt.

25 Claims, 12 Drawing Sheets

Related U.S. Application Data continuation of application No. 14/941,342, filed on Nov. 13, 2015, now Pat. No. 9,956,450, which is a continuation of application No. 14/517,478, filed on Oct. 17, 2014, now Pat. No. 9,216,316, which is a continuation of application No. 13/257,038, filed as application No. PCT/US2010/026731 on Mar. 9, 2010, now Pat. No. 8,864,627.

(60) Provisional application No. 61/161,027, filed on Mar. 17, 2009.

(51) Int. Cl.
*A63B 21/00* (2006.01)
*A63B 22/02* (2006.01)
*A63B 23/04* (2006.01)

(52) U.S. Cl.
CPC ..... *A63B 21/157* (2013.01); *A63B 22/0017* (2015.10); *A63B 22/0023* (2013.01); *A63B 22/02* (2013.01); *A63B 22/0235* (2013.01); *A63B 22/0285* (2013.01); *A63B 23/04* (2013.01); *A63B 2230/06* (2013.01); *A63B 2230/75* (2013.01)

(56) References Cited

U.S. PATENT DOCUMENTS 83,844 A 11/1868 Goucher
104,534 A 6/1870 Ashe
111,018 A 1/1871 Thompson
118,030 A 8/1871 Loveghove et al.
144,224 A 11/1873 Potter
144,225 A 11/1873 Purple
171,353 A 12/1875 Conway
179,789 A 7/1876 Hedges
219,439 A 9/1879 Blend
254,293 A 2/1882 Edleblute et al.
314,674 A 3/1885 Hubbard
374,811 A 12/1887 Savage
411,986 A 10/1889 Frazeuretal
641,424 A 1/1900 Taitel et al.
759,296 A 5/1904 Morairty
767,221 A 8/1904 Hagen
783,769 A 2/1905 Wright
931,394 A 8/1909 Day
1,016,729 A 2/1912 Barrett
1,211,765 A 1/1917 Schmidt
2,117,957 A 5/1938 Heller
2,399,915 A 5/1946 Drake
2,512,911 A 6/1950 Benice
2,842,365 A 7/1958 Kelley
3,637,206 A 1/1972 Chickering, III
3,642,279 A 2/1972 Cutter
3,728,261 A 4/1973 Mitacek
3,870,297 A 3/1975 Elder
3,968,543 A 7/1976 Shino et al.
4,334,676 A 6/1982 Schonenberger
4,389,047 A 6/1983 Hall
4,406,451 A 9/1983 Gaetano
4,544,152 A 10/1985 Taitel
4,548,405 A 10/1985 Lee et al.
4,576,352 A 3/1986 Ogden
4,614,337 A 9/1986 Schonenberger
4,635,928 A 1/1987 Ogden et al.
4,659,074 A 4/1987 Taitel et al.
4,726,581 A 2/1988 Chang
4,886,266 A 12/1989 Trulaske
4,938,469 A 7/1990 Crandell
5,018,343 A 5/1991 Finke
5,031,901 A 7/1991 Saarinen
5,044,470 A 9/1991 Nicholas
5,094,447 A 3/1992 Wang
5,145,480 A 9/1992 Wang
5,162,988 A 11/1992 Semerau et al.
D333,887 S 3/1993 Dowler
5,242,339 A 9/1993 Thornton
5,290,205 A 3/1994 Densmore et al.
5,310,392 A 5/1994 Lo
5,318,487 A 6/1994 Golen et al.
5,368,532 A 11/1994 Farnet
5,378,213 A 1/1995 Quint
5,411,279 A * 5/1995 Magid ..... A47D 13/043 198/833
5,411,455 A 5/1995 Haber et al.
5,431,612 A 7/1995 Holden
5,470,293 A 11/1995 Schonenberger
5,492,517 A 2/1996 Bostic et al.
5,538,489 A 7/1996 Magid
5,575,740 A 11/1996 Piaget et al.
5,577,598 A 11/1996 Schoenenberger
5,607,376 A 3/1997 Magid
5,643,144 A 7/1997 Trulaske
5,669,856 A 9/1997 Liu
5,683,332 A 11/1997 Watterson et al.
5,688,209 A 11/1997 Trulaske et al.
5,709,632 A 1/1998 Socwell
5,856,736 A 1/1999 Rotunda et al.
5,887,579 A 3/1999 Eriksson et al.
5,891,830 A 4/1999 Koltermann et al.
5,897,461 A * 4/1999 Socwell ..... A63B 22/0012 482/54
6,042,514 A 3/2000 Abelbeck
6,053,848 A 4/2000 Eschenbach
6,056,072 A 5/2000 Koltermann et al.
6,095,952 A 8/2000 Ali et al.
6,146,315 A 11/2000 Schonenberger
6,152,854 A 11/2000 Carmein
6,180,210 B1 1/2001 Debus
6,328,676 B1 12/2001 Alessandri
6,334,836 B1 1/2002 Segasby
6,334,839 B1 1/2002 Lim et al.
6,348,025 B1 2/2002 Schonenberger
6,454,679 B1 9/2002 Radow
6,468,189 B2 10/2002 Alessandri
6,500,097 B1 12/2002 Hall
6,616,578 B2 9/2003 Alessandri
6,652,424 B2 11/2003 Dalebout
D484,554 S 12/2003 Hellman et al.
6,740,009 B1 5/2004 Hall
6,761,667 B1 * 7/2004 Cutler ..... A63B 22/0023 482/51
6,824,502 B1 11/2004 Huang
6,837,830 B2 1/2005 Eldridge
6,893,382 B1 5/2005 Moon et al.
6,923,746 B1 8/2005 Skowronski et al.
6,958,032 B1 10/2005 Smith et al.
7,090,620 B1 8/2006 Barlow
7,115,073 B2 10/2006 Nizamuddin
7,179,205 B2 2/2007 Schmidt
D562,416 S 2/2008 Fedriga et al.
D566,209 S 4/2008 Alessandri et al.
7,410,449 B2 8/2008 Yeh
7,560,822 B1 7/2009 Hoffmann
7,608,023 B2 10/2009 Casagrande
7,618,345 B2 11/2009 Corbalis et al.
7,704,191 B2 4/2010 Smith et al.
7,717,828 B2 5/2010 Simonson et al.
7,780,573 B1 8/2010 Carmein
7,789,800 B1 9/2010 Watterson et al.
7,806,805 B2 10/2010 Barufka et al.
7,837,596 B2 11/2010 Astilean
7,862,483 B2 1/2011 Hendrickson et al.
8,007,408 B1 * 8/2011 Moran ..... A63B 22/025 482/54
8,007,422 B2 8/2011 Zaccherini
8,075,450 B2 12/2011 Fabbri et al.
8,206,269 B2 6/2012 Fabbri et al.
8,241,187 B2 8/2012 Moon et al.
8,308,619 B1 11/2012 Astilean
D672,827 S 12/2012 Alessandri et al.
8,343,016 B1 1/2013 Astilean
D682,372 S 5/2013 Alessandri et al.

(56) References Cited

U.S. PATENT DOCUMENTS

| | | | |
|---|---|---|---|
| 8,496,566 | B2 | 7/2013 | Casadei |
| 8,512,209 | B2 | 8/2013 | Guidi et al. |
| 8,585,561 | B2 | 11/2013 | Watt et al. |
| 8,676,170 | B2 | 3/2014 | Porrati et al. |
| 8,690,738 | B1 | 4/2014 | Astillian |
| 8,734,300 | B2 | 5/2014 | Piaget et al. |
| 8,864,627 | B2 | 10/2014 | Bayerlein et al. |
| 8,876,668 | B2 | 11/2014 | Hendrickson et al. |
| 8,920,347 | B2 | 12/2014 | Bayerlein et al. |
| 9,005,085 | B2 | 4/2015 | Astilean |
| 9,044,635 | B2 | 6/2015 | Lull |
| D736,866 | S | 8/2015 | Oblamski et al. |
| 9,192,810 | B2 | 11/2015 | Beard et al. |
| 9,216,316 | B2 | 12/2015 | Bayerlein et al. |
| 9,233,272 | B2 | 1/2016 | Villani et al. |
| 9,254,409 | B2 | 2/2016 | Dalebout et al. |
| D751,156 | S | 3/2016 | Tasca et al. |
| 9,305,141 | B2 | 4/2016 | Fabrizio |
| 9,314,667 | B2 | 4/2016 | Puerschel |
| 9,352,188 | B2 | 5/2016 | Astilean |
| 9,429,511 | B1 | 8/2016 | Kannel |
| 9,498,696 | B1 | 11/2016 | Razon |
| 9,595,855 | B2 | 3/2017 | Asai et al. |
| D788,792 | S | 6/2017 | Alessandri et al. |
| 9,694,234 | B2 | 7/2017 | Dalebout et al. |
| 9,824,110 | B2 | 11/2017 | Giudici et al. |
| 9,914,015 | B2 | 3/2018 | Astilean et al. |
| 9,956,450 | B2 | 5/2018 | Bayerlein et al. |
| 9,974,997 | B2 | 5/2018 | Cei |
| D820,362 | S | 6/2018 | Citterio |
| 10,010,748 | B1 | 7/2018 | Weinstein et al. |
| D827,058 | S | 8/2018 | Lisi et al. |
| 10,143,884 | B2 | 12/2018 | Cei |
| D837,312 | S | 1/2019 | Lisi et al. |
| 10,183,191 | B2 | 1/2019 | Astilean et al. |
| 10,293,204 | B2 | 5/2019 | Astilean et al. |
| 10,478,666 | B2 | 11/2019 | Yoo |
| 2001/0018917 | A1 | 9/2001 | Brain |
| 2002/0147079 | A1 | 10/2002 | Kalnbach |
| 2003/0148853 | A1 | 8/2003 | Alessandri et al. |
| 2003/0186787 | A1 | 10/2003 | Wu et al. |
| 2004/0018917 | A1 | 1/2004 | Corbalis et al. |
| 2004/0077465 | A1 | 4/2004 | Schmidt |
| 2004/0097341 | A1 | 5/2004 | Alessandri et al. |
| 2004/0241631 | A1 | 12/2004 | Nizamuddin |
| 2004/0242631 | A1 | 12/2004 | Garlich et al. |
| 2004/0244521 | A1 | 12/2004 | Russ et al. |
| 2005/0009668 | A1 | 1/2005 | Savettiere et al. |
| 2005/0202936 | A1 | 9/2005 | Ota |
| 2005/0209059 | A1 | 9/2005 | Crawford et al. |
| 2005/0272562 | A1 | 12/2005 | Alessandri et al. |
| 2006/0003871 | A1 | 1/2006 | Houghton et al. |
| 2006/0003872 | A1 | 1/2006 | Chiles et al. |
| 2006/0122035 | A1 | 6/2006 | Felix |
| 2006/0287165 | A1 | 12/2006 | Pasqualin |
| 2007/0021278 | A1 | 1/2007 | Pan et al. |
| 2007/0027001 | A1 | 2/2007 | Alessandri et al. |
| 2007/0054781 | A1 | 3/2007 | Blaylock |
| 2007/0123396 | A1 | 5/2007 | Ellis |
| 2007/0167289 | A1 | 7/2007 | Alessandri et al. |
| 2007/0202995 | A1 | 8/2007 | Roman et al. |
| 2007/0225130 | A1 | 9/2007 | Maffei et al. |
| 2007/0298935 | A1 | 12/2007 | Badarneh et al. |
| 2008/0015094 | A1 | 1/2008 | Casagrande |
| 2008/0020907 | A1 | 1/2008 | Lin |
| 2008/0026914 | A1 | 1/2008 | Chen et al. |
| 2008/0119332 | A1 | 5/2008 | Roman |
| 2008/0132385 | A1 | 6/2008 | Alessandri et al. |
| 2008/0287266 | A1 | 11/2008 | Smith |
| 2009/0062165 | A1 | 3/2009 | Denis et al. |
| 2009/0105047 | A1 | 4/2009 | Guidi et al. |
| 2009/0156363 | A1 | 6/2009 | Guidi et al. |
| 2009/0170666 | A1 | 7/2009 | Chiang |
| 2009/0215589 | A1 | 8/2009 | Schoenenberger |
| 2009/0280960 | A1 | 11/2009 | Tian |
| 2010/0087298 | A1 | 4/2010 | Zaccherini |
| 2010/0216607 | A1 | 8/2010 | Mueller |
| 2010/0222182 | A1 | 9/2010 | Park |
| 2011/0027549 | A1 | 2/2011 | Boutaghou |
| 2011/0048809 | A1 | 3/2011 | Duckworth et al. |
| 2011/0266091 | A1 | 11/2011 | Taylor |
| 2011/0275497 | A1 | 11/2011 | Lorusso |
| 2011/0306527 | A1 | 12/2011 | Bouffet et al. |
| 2012/0010048 | A1 | 1/2012 | Bayerlein et al. |
| 2012/0010053 | A1 | 1/2012 | Bayerlein et al. |
| 2012/0019973 | A1 | 1/2012 | Ehrmantraut et al. |
| 2012/0149613 | A1 | 6/2012 | David et al. |
| 2012/0157267 | A1 | 6/2012 | Lo |
| 2012/0231934 | A1 | 9/2012 | Lo |
| 2012/0264569 | A1 | 10/2012 | Escobedo et al. |
| 2012/0270705 | A1 | 10/2012 | Lo |
| 2013/0256064 | A1 | 10/2013 | Bongaerts et al. |
| 2014/0011642 | A1 | 1/2014 | Astilean |
| 2014/0080679 | A1 | 3/2014 | Bayerlein et al. |
| 2014/0087922 | A1 | 3/2014 | Bayerlein et al. |
| 2014/0171272 | A1 | 6/2014 | Hawkins et al. |
| 2014/0239760 | A1 | 8/2014 | Asai et al. |
| 2015/0119202 | A1 | 4/2015 | Hendrickson et al. |
| 2015/0157895 | A1 | 6/2015 | Bettini |
| 2015/0306456 | A1 | 10/2015 | Pasini et al. |
| 2015/0367175 | A1 | 12/2015 | Alessandri et al. |
| 2016/0023039 | A1 | 1/2016 | Cei |
| 2016/0096064 | A1 | 4/2016 | Gatti |
| 2016/0144224 | A1 | 5/2016 | Dalebout et al. |
| 2016/0144225 | A1 | 5/2016 | Dalebout et al. |
| 2016/0166877 | A1 | 6/2016 | Cei et al. |
| 2016/0263429 | A1 | 9/2016 | Wagner |
| 2016/0296789 | A1 | 10/2016 | Astilean et al. |
| 2016/0367851 | A1 | 12/2016 | Astilean et al. |
| 2017/0007886 | A1 | 1/2017 | Alessandri |
| 2017/0113093 | A1 | 4/2017 | Bellavista et al. |
| 2017/0128769 | A1 | 5/2017 | Long et al. |
| 2017/0182356 | A1 | 6/2017 | Cei et al. |
| 2017/0274248 | A1 | 9/2017 | Brown et al. |
| 2017/0312582 | A1 | 11/2017 | Root, Jr. |
| 2018/0001134 | A1 | 1/2018 | Bayerlein et al. |
| 2018/0014755 | A1 | 1/2018 | Alessandri et al. |
| 2018/0104534 | A1 | 4/2018 | Erkelenz et al. |
| 2018/0111018 | A1 | 4/2018 | Lee |
| 2018/0111023 | A1 | 4/2018 | Cei et al. |
| 2018/0229065 | A1 | 8/2018 | Leonardi et al. |
| 2019/0054344 | A1 | 2/2019 | Athey et al. |
| 2019/0083843 | A1 | 3/2019 | Del Monaco et al. |
| 2019/0083844 | A1 | 3/2019 | Bayerlein et al. |
| 2019/0118030 | A1 | 4/2019 | Yoo |
| 2019/0168067 | A1 | 6/2019 | Bates et al. |
| 2019/0314674 | A1 | 10/2019 | Chen |
| 2019/0374811 | A1 | 12/2019 | Bayerlein et al. |
| 2020/0171353 | A1 | 6/2020 | Fima |
| 2020/0179789 | A1 | 6/2020 | Fima |
| 2020/0188760 | A1 | 6/2020 | Bandini et al. |
| 2020/0215391 | A1 | 7/2020 | Paganelli et al. |
| 2020/0254293 | A1 | 8/2020 | Bayerlein et al. |

FOREIGN PATENT DOCUMENTS

| | | | |
|---|---|---|---|
| CN | 201006229 | | 1/2008 |
| CN | 201030178 | | 3/2008 |
| CN | 201333278 | | 10/2009 |
| CN | 102309835 | A | 1/2012 |
| DE | 19922822.2 | A1 | 12/2000 |
| DE | 10 2005 009 414 | | 9/2006 |
| DE | 20-2006-005995 | | 9/2006 |
| EP | 1 466 651 | A1 | 10/2004 |
| GB | 2 223 685 | A | 4/1990 |
| JP | 03-148743 | | 6/1991 |
| JP | 3148743 | | 2/2009 |
| KR | 2009007043 | | 1/2009 |
| KR | 10-2016-0150084 | A | 12/2016 |
| WO | WO-2009/014330 | A1 | 1/2009 |
| WO | WO-2010/057238 | A2 | 5/2010 |
| WO | WO-2010/107632 | | 9/2010 |
| WO | WO-2014/160057 | | 10/2014 |
| WO | WO-2016/163680 | A1 | 10/2016 |

(56) References Cited

FOREIGN PATENT DOCUMENTS

OTHER PUBLICATIONS

U.S. Appl. No. 08/152,177, filed Nov. 12, 1993, Schonenberger et al.
U.S. Appl. No. 61/280,265, filed Nov. 2, 2009, Astilean, Aurel A.
Andrews et al., The Effect of An 80-Minute Intermittent Running Protocol on Hamstrings Strength Abstract, NSCA Presentation, Jul. 15, 2006, 1 page.
Answer to Counterclaims filed Nov. 14, 2014 between Speedfit LLC and Aurel Astilean versus Woodway USA, Inc., 8 pages.
Astilean, Alex, YouTube Video entitled "SpeedFit—Speedboard—First Curve Prototype" retrieved from the internet at: https://www.youtube.com/watch?v=dO9h-F-JVCU on Apr. 6, 2015, 49 pages of screenshots.
Biodex Medical Systems, Inc., "The Biodex RTM Rehabilitation Treadmill Operation Manual", believed to have published 2002, 48 pages.
Brughelli et al., Effects of Running Velocity on Running Kinetics and Kinematics, Journal of Strength and Conditioning Research, Apr. 2011, 7 pages.
Buchheit et al., "Assessing Stride Variables and Vertical Stiffness with GPS-Embedded Accelerometers: Preliminary Insights for Monitoring of Neuromuscular Fatigue on the Field", Dec. 2015.
Chapco, Inc. and Samsara Fitness LLC's notice pursuant to 34 U.S.C. §282, Case 3:15-CV-01665-JCH, Document 310, filed Sep. 14, 2018, 4 pps.
Claim Construction Order, *Speedfit LLC and Aurel A. Astilean* v. *Woodway USA, Inc.,* Docket No. 2:13-cv-01276-KAM-AKT, Nov. 20, 2017, 23 pages.
Complaint for Declaratory Judgment of Patent Invalidity and Correction of Inventorship, *Woodway USA, Inc.* v. *Aurel A. Astilean,* Civ. Dkt. No. 2:13-cv-00681-WEC (E.D. WI), Jun. 13, 2013, 6 pages.
Coolthings, "Woodway EcoMill: A Non-Motorized Treadmill with Electronic Displays", Jun. 4, 2009, https://www.coolthings.com/woodway-ecomill-a-non-motorized-treadmill-with-electronic-displays/, 1 page.
Curvature, http://en.wikipedia.org/wiki/Curvature, Mar. 3, 2010, 1 page.
Decision and Order Denying Defendant's Motion to Dimiss or to Transfer and Staying Case Pending Decision from Eastern District New York District Court, *Woodway USA, Inc.* v. *Aurel A. Astilean,* Civ. Dkt. No. 2:13-cv-00681-WEC (E.D. WI), Dec. 18, 2013, 7 pages.
Declaration of Aurel A. Astilean filed Jun. 15, 2015 between *Speedfit LLC and Aurel Astilean* versus *Woodway USA, Inc.* and Exhibit A.
Declaration of Aurel A. Astilean, *Speedfit LLC and Aurel A. Astilean* v. *Woodway USA, Inc.,* Docket No. 2:17-cv-00768-KAM-AKT, Exhibit 1, Mar. 26, 2018, 5 pages.
Declaration of Dan Bostan filed Jun. 15, 2015 between *Speedfit LLC and Aurel Astilean* versus *Woodway USA, Inc.* and Exhibit A.
Declaration of John F. Vodopia filed Jun. 6, 2017.
Declaration of John F. Vodopia in Further Support of Plaintiffs' Motion for Leave to Amend filed Jul. 7, 2015 and Exhibits A-C.
Declaration of John F. Vodopia In Support of Plaintiffs' motion for Leave to Amend filed Jul. 7, 2017 and Exhibits A-F.
Declaration of John F. Vodopia in Support of Plaintiffs' Motion Under 35 USC 256 to Correct Inventorship of U.S. Pat. No. 8,308,619 and U.S. Pat. No. 8,342,016 filed Jun. 15, 2015 between *Speedfit LLC and Aurel Astilean* versus *Woodway USA, Inc.* and Exhibits A-H.
Declaration of Kadie M. Jelenchick filed Jul. 7, 2015 and Exhibits A-G.
Declaration of Kadie M. Jelenchick filed Jun. 15, 2015 and Exhibits A, B and E.
Declaration of Kadie M. Jelenchick filed Jun. 6, 2017.
Declaration of Matthew W. Peters, Case 2:13-cv-01276-KAM-AKT, Document 213, filed Aug. 8, 2018, 2 pps.
Declaration of Nicholas Oblamski filed Jun. 15, 2015, and Exhibit A, 11 pages.
Declaration of Nicholas Oblamski, *Speedfit LLC and Aurel A. Astilean* v. *Woodway USA, Inc.,* Docket No. 2:17-cv-00768-KAM-AKT, Exhibit 1, Mar. 26, 2018, 12 pages.
Declaration of Robert Giachetti, Case 3:15-CV-01665-JCH, Document 88-2, filed May 1, 2017, 20 pps., marked on its face as Exhibit 1.
Declaration of Thomas B. Decea filed Nov. 19, 2015 between *Speedfit LLC and Aurel Astilean* versus *Woodway USA, Inc.*
Defendant Woodway USA, Inc.'s responses and objections to plaintiffs first set or interrogatories, Case 3:15-CV-01665-JCH, Document 254-22, 17 pps., marked on its face as Exhibit 22.
Discovery Channel, "Wreckreation Nation", Season 1, Episode 8, first aired Feb. 24, 2009, 9 pages of screenshot excerpts.
Docket Report, *Speedfit LLC and Aurel A. Astilean* v. *Douglas G. Bayerlain,* Civ. Dkt. No. 2:13-cv-01276-KAM-AKT (E.D.N.Y.), Dec. 19, 2013, 8 pages.
Docket Report, *Woodway USA, Inc.* v. *Aurel A. Astilean,* Civ. Dkt. No. 2:13-cv-00681-WEC (E.D. WI), Dec. 19, 2013, 3 pages.
EMS-Grivory Grivory GV-5H Black 9915 Nylon Copolymer, 50% Glass Fiber Filled, As Conditioned, believed to be publically available before Sep. 16, 2011, 2 pages.
Excerpt from U.S. Appl. No. 14/076,912, Exhibit F, *Speedfit LLC and Aurel A. Astilean* v. *Woodway USA, Inc.,* Docket No. 2:17-cv-00768-KAM-AKT, Mar. 26, 2018, 4 pages.
Expert report of Dr. Robert Giachetti, Case 3:15-CV-01665-JCH, Document 216-2, filed Apr. 5, 2018, 31 pps., marked on its face as Exhibit 2.
Expert report of James D. Whelan, P.E., report dated Aug. 26, 2015, Case 2:13-cv-01276-KAM-AKT, Document 212-2, filed Aug. 8, 2018, 19 pps., marked on its face as Exhibit 2.
Expert report of James D. Whelan, P.E., report dated Jul. 27, 2015, Case 2:13,cv-01276-KAM-AKT, Document 212-1, filed Aug. 8, 2018, 62 pps., marked on its face as Exhibit 1.
Expert report of James D. Whelan, P.E., report dated Jun. 12, 2018, 30 pps.
Expert report of James D. Whelan, P.E., report dated Sep. 28, 2018, 10 pps.
Expert Report of Kim B. Blair, Ph.D., Case 3:15-CV-01665-JCH, Document 254-7, filed Jun. 8, 2018, 135 pps., marked on its face as Exhibit 7.
First Amended Complaint (Jury Trial Demanded), *Speedfit LLC and Aurel A. Astilean* v. *Douglas G. Bayerlein,* Civ. Dkt. No. 2:13-cv-01276-KAM-AKT (E.D.N.Y.), Jun. 17, 2013, 16 pages.
First Amended Complaint filed Jun. 17, 2013 between *Speedfit LLC and Aurel Astilean* versus *Woodway USA, Inc.,* 16 pages.
Hall, The Rotary TREADWHEEL, available at least as early as Nov. 2011, 1 page.
HDT Expeditionary Systems, Inc., "KineAssist-MX Owner's Manual vG", 2015, 73 pages.
Hersher, Perfect Landing, http://news.harvard.edu/gazette/story/2010/01/different-strokes/, Jan. 27, 2010, 5 pages.
Hersher, Pertect Landing, http://news.harvard.edu/gazette/story/2010/01/difterent-strokes/, Feb. 26, 2010, 5 pages.
Hopker et al., Familiarisation and Reliability of Sprint Test Indices During Laboratory and Field Assessment, Journal of Sports Science and Medicine, Dec. 1, 2009, 5 pages.
http://www.gettyimages.com/detail/463782507, Animal treadmill c. 1872, Museum of Science and Industry, Chicago, 3 pps.
http://www.gettyimages.com/license/542395667, 1930 era treadmill, 1 page.
http://www.mpiwg-berlin.mpg.de/resrep00_01/Jahresbericht_2_2_section.html, 27 pps.
Integrated Performance Systems, LLC, Conditioning in a Professional Athlete Case Study, 2005, 1 page.
Integrated Performance Systems, LLC, Lower Extremity Rehabilitation & Assessment Case Study, 2005, 2 pages.
Integrated Performance Systems, LLC, Youth Athlete-Speed Training Case Study, 2005, 2 pages.
International Preliminary Report for Application No. PCT/US2010/026731, dated Sep. 29, 2011, 7 pages.

(56) References Cited

OTHER PUBLICATIONS

International Preliminary Report for Application No. PCT/US2010/027543, dated Sep. 29, 2011, 9 pages.
International Search Report and Written Opinion for Application No. PCT/US2010/026731, dated May 4, 2010, 8 pages.
International Search Report and Written Opinion for Application No. PCT/US2010/027543, dated May 12, 2010, 10 pages.
International Search Report and Written Opinion for International Application No. PCT/US2016/055572, dated Feb. 17, 2017, 9 pages.
International Search Report, PCT/US2017/040449, Oct. 11, 2017, 6 pages.
International Standard ISO 20957-6:2005(E), for Stationary training equipment—Part 6: Treadmills, additional specific safety requirements and test methods, First edition May 1, 2005, 18pps.
Introducing the New Force 3 Treadmill Advanced Analysis Package, www.fittech.com.au, believed to be publically available before Sep. 16, 2011, 3 pages.
Joint Disputed Claim filed Apr. 19, 2017 between *Speedfit LLC and Aurel Astilean* versus *Woodway USA, Inc.,* 10 pages.
Lieberman et al., Running Barefoot, Forefoot Striking & Training Tips, http://www.barefootrunning.fas.harvard.edu/5BarefootRunning&TrainingTips.html, Feb. 26, 2010, 5 pages.
Lieberman et al., Running Barefoot: Biomechanics of Foot Strike, http://www.barefootrunning.fas.harvard.edu/4Biomechanicsof-FootStrike.html, Feb. 26, 2010, 6 pages.
Lieberman et al., Running Barefoot: Biomechanics of Foot Strikes & Applications to Running Barefoot or in Minimal Footwear, http://www.barefootrunning.fas.harvard.edu/index.html, Feb. 26, 2010, 2 pages.
Lieberman et al., Running Barefoot: FAQ, http://www.barefootrunning.fas.harvard.edu/6FAQ.html, Feb. 26, 2010, 3 pages.
Lieberman et al., Running Barefoot: Heel Striking & Running Shoes, http://www.barefootrunning.fas.harvard.edu/2FootStrikes&RunningShoes.html, Feb. 26, 2010, 2 pages.
Lieberman et al., Running Barefoot: Running Before the Modern Shoe, http://www.barefootrunning.fas.harvard.edu/3RunningBeforeTheModernShoe.html, Feb. 26, 2010, 4 pages.
Lieberman et al., Running Barefoot: Why Consider Foot Strike, http://www.barefootrunning.fas.harvard.edu/1WhyConsiderFootStrike.html, Feb. 26, 2010, 1 page.
Liszewski, Andrew, "EcoMill Treadmill Generates Its Own Power", Jun. 1, 2009, http://www.ohgizmo.com/2009/06/04/ecomill-treadmill-generates-its-own-power/, 1 page.
Memorandum and Order filed Dec. 28, 2016 between *Speedfit LLC and Aurel Astilean* versus *Woodway USA, Inc.,* 22 pages.
Memorandum and Order filed Oct. 10, 2014 between *Speedfit LLC and Aurel Astilean* versus *Woodway USA, Inc.,* 39 pages.
Memorandum and Order filed Oct. 19, 2015 between *Speedfit LLC and Aurel Astilean* versus *Woodway USA, Inc.,* 11 pages.
Memorandum of Law in Support of Plaintiffs' Motion for Leave to Amend the Second Amended Complaint filed Jul. 7, 2015, 13 pages.
Memorandum of Law in Support of Plaintiffs' Motion Under 35 USC 256 to Correct Inventorship of SPN 8,308,619 and U.S. Pat. No. 8,342,016 between *Speedfit LLC and Aurel Astilean* versus *Woodway USA, Inc.,* 14 pages.
Minute Entry and Order for Markman Hearing, dated Jun. 13, 2018, 2 pps.
Minute Entry for Proceedings on Nov. 10, 2015 and Exhibit G.
Minute Order Regarding Claim Construction, *Speedfit LLC* v. *Woodway,* Docket No. 2:17-cv-00768-KAM-AKT, Jun. 13, 2018, 2 pages.
Moody, The Effects Resisted Sprint Training on Speed, Agility and Power Production in Young Athletes, believed to be publically available before Dec. 31, 2006, 5 pages.
Motion to Dismiss filed Oct. 30, 2015 and Exhibits A-H.
NASA, "Combined Operational Load Bearing External Resistance Treadmill (COLBERT)", Aug. 2009, 3 pages.
NASA, "International Space Station: Combined Operational Load Bearing External Resistance Treadmill (COLBERT)", Jul. 19, 2017, https://www.nasa.gov/mission_pages/station/research/experiments/765.html, 4 pages.
NASA, "International Space Station: Do Tread on Me", Aug. 19, 2009, https://www.nasa.gov/mission_pages/station/behindscenes/colbert_feature.html, 2 pages.
NASA, "International Space Station: Treadmill with Vibration Isolation and Stabilization System (TVIS)", May 17, 2018, https://www.nasa.gov/mission_pages/station/research/experiments/976.html, 5 pages.
NASA, "Space Shuttle Mission STS-128: Racking Up New Science", Press Kit, Aug. 2009, 116 pages.
Nexus Resin Group, 10124 Antistat, believed to be publically available before Sep. 16, 2011, 2 pages.
Notice of Motion filed Jul. 7, 2015 between *Speedfit LLC and Aurel Astilean* versus *Woodway USA, Inc.,* 2 pages.
Notice of Motion Under 35 USC 256 to Correct Inventorship of U.S. Pat. No 8,308,619 and U.S. Pat. No. 8,342,016 filed Jun. 15, 2015 between *Speedfit LLC and Aurel Astilean* versus *Woodway USA, Inc.,* 3 pages.
Notice of Woodway USA, Inc.'s Motion for Summary Judgment of Invalidity of U.S. Pat. Nos. 8,308,619 and 8,343,016 filed Jun. 5, 2017, 9 pages.
Notice of Woodway USA, Inc.'s motion to preclude the testimony of plaintiffs' technical expert James Whelan, Case 2:13-CV-01276-KAM-AKT, Document 211, filed Aug. 8, 2018, 3 pps.
Opening expert report of Dr. Robert Giachetti re: invalidity of U.S. Pat. No. 8,986,169 and U.S. Pat. No. 9,039,580, Case 3:15-CV-01665-JCH, Document 216-1, filed Apr. 5, 2018, 67 pps., marked on its face as Exhibit 1.
Order Denying Motion for Reconsideration (Doc. No. 248), dated Jun. 20, 2018, 12 pps.
OSHA 1926.307,9 pps.
Owners Manual for NordicTrack WalkFit Classic Treadmill, received on Mar. 2, 2017, 30 pps.
Owners Manual, Force 1, Nov. 29, 2007, 44 pages.
Owners Manual, Force 3, Jan. 28, 2009, 45 pages.
Owners Manual, The Force, Dec. 18, 2008, 68 pages.
Photographs of public display of Speedfit Speedboard by Woodway presented at IHRSA Tradeshow on Mar. 17, 2009, 8 pages.
Photographs produced to Woodway at least by Nov. 10, 2014 in litigation, *Speedfit LLC and Aurel A. Astilean* v. *Woodway USA, Inc.,* No. 2:13-cv-01276-KAM-AKT, 11 pages.
Plaintiff's memorandum in support of motion for summary judgment of non-infringement and invalidity on Claim 25 of U.S. Pat. No. 9,039,580, Case 3:15-CV-01665-JCH, Document 253, filed Jun. 8, 2018, 45 pps.
Plaintiff's Reply to Defendant Woodway's Answer, Affirmative Defenses and Counterclaims to Plaintiff's Second Amended Complaint filed Mar. 27, 2015, 6 pages.
Plaintiff's Reply to Defendant Woodway's Answer, Affirmative Defenses and Counter-Claims to Plaintiffs' Supplemental Complaint filed Mar. 17, 2017, 8 pages.
Plaintiff's supplemental responses and objections to defendant's first set of interrogatories, Case 2:17-cv-00768-KAM-AKT, Document 38-3, filed Mar. 14, 2018, 22 pps., marked on its face as Exhibit C.
Plaintiffs Memorandum of Law in Opposition to Woodway's Motion for Summary Judgement of Invalidity and Opening Claim Construction Brief, Cross-Motion for Summary Judgment Upholding Validity, Cross-Motion for Summary Judgment for Infringement and Motion to Extend the Page Limitation for this Memorandum filed Jun. 6, 2017, 46 pages.
Plaintiffs' Initial Claims Construction Memorandum filed Jul. 31, 2017.
Plaintiffs' Local Rule 56(a)1 statement of undisputed material facts, Case 3:15-CV-01665-JCH, Document 254, filed Jun. 8, 2018, 14 pps.
Plaintiffs' Local Rule 56(a)2 statement of facts in opposition to summary judgment, Case 3:15-CV-01665-JCH, Document 265, filed Jun. 29, 2018, 17 pps.

(56) References Cited

OTHER PUBLICATIONS

Plaintiffs' Memorandum of Law in further Opposition to Defendant's Motion to Dismiss Certain of Plaintiffs' Claims filed Nov. 19, 2015, 19 pages.
Plaintiffs' memorandum of law in support of their motion for partial reconsideration, Case 3:15-CV-01665-JCH, Document 249, filed May 8, 2018, 9 pps.
Plaintiffs' motion for partial reconsideration, Case 3:15-CV-01665-JCH, Document 248, filed May 7, 2018, 3 pps.
Plaintiffs' motion for summary judgment of non-infringement and invalidity on Claim 25 of U.S. Pat. No. 9,039,580, Case 3:15-CV-01665-JCH, Document 252, 2 pps.
Plaintiffs' Opposition to Woodway USA, Inc.'s motion for summary judgment of infringement on Claim 25 of U.S. Pat. No. 9,039,580, Case 3:15-CV-01665-JCH, Document 264, filed Jun. 29, 2018, 35 pps.
Plaintiffs' preliminary invalidity contentions, Case 3:15-CV-01665-JCH, Document 254-16, filed Jun. 8, 2018, 205 pps., marked on its face as Exhibit 16.
Plaintiffs' preliminary non-infringement contentions, Case 3:15-cv-01165-JCH, Document 96-3, filed May 2, 2017, 56 pps.
Plaintiffs' Reply in Support of motion for partial reconsideration, Case 3:15-CV-01665-JCH, Document 251, filed May 29, 2018, 4 pps.
Plaintiffs' supplemental non-infringement contentions, Case 3:15-CV-01665-JCH, Document 98-8, filed May 2, 2017, 60 pps.
Plantar Fascia, http://en.wikipedia.org/wiki/Plantar_fascia, Mar. 3, 2010, 3 pages.
Rebuttal expert report of Kim B. Blair, Ph.D., Case 2:13-cv-01276-KAM-AKT, Document 213-3, filed Aug. 8, 2018, 24 pps., marked on its face as Exhibit C.
Rebuttal Expert Report of Kim B. Blair, Ph.D., Case 3:15-CV-01665-JCH, Document 254-15, 184 pps., marked on its face as Exhibit 15.
Reply in Opposition to D126 filed Nov. 6, 2015 and Exhibits A and B.
Reply Memorandum of Law in Further Support of Plaintiffs' Motion for Leave to Amend the Second Amended Complaint filed Jul. 7, 2015 between *Speedfit LLC and Aurel Astilean* versus *Woodway USA, Inc.,* 13 pages.
Response in Opposition re [117] First Motion to Amend Second Amended Complaint filed Jul. 7, 2015, 2 pages.
Response in Opposition to [110] Motion to Amend-Corret-Supplement filed Jun. 15, 2015, 2 pages.
Revised Answer to Counterclaims filed Dec. 12, 2014 between *Speedfit LLC and Aurel Astilean* versus *Woodway USA, Inc.,* 5 pages.
Ross et al., The Effects of Treadmill Sprint Training and Resistance Training on Maximal Running Velocity and Power, National Strength and Conditioning Association, Mar. 2009, 10 pages.
Rule 56.1 Counter-Statement by Plaintiffs Speedfit LLC, and Aurel A. Astilean filed Jun. 6, 2017, 13 pages.
Ruling Re: Plaintiffs' Motion for Summary Judgment of Non-infringement and Invalidity (Doc. No. 252) and Woodway's Motion for Summary Judgment of Infringement (Doc. No. 255), *Chapco, Inc. and Samsara Fitness, LLC* v. *Woodway USA, Inc.,* Docket No. 3:15-cv-01665-JCH, Jul. 24, 2018, 26 pages.
Second Amended Complaint filed Feb. 17, 2015 between *Speedfit LLC and Aurel Astilean* versus *Woodway USA, Inc.,* 18 pages.
Second supplemental Expert report of Kim B. Blair, PhD., Case 3:15-CV-01665-JCH, Document 254-3, 41 pps., marked on its face as Exhibit 3.
Sirotic et al., Physiological and Performance Test Correlates of Prolonged, High-Intensity, Intermittent Running Performance in Moderately Trained Women Team Sport Athletes, Journal of Strength and Conditioning Research, 2007, 7 pages.
Sirotic et al., The Reliability of Physiological and Performance Measures During Simulated Team-Sport Running on a Non-Motorised Treadmill, Journal of Science and Medicine in Sport, Apr. 11, 2007, 10 pages.
Soccer International, The Red Devil's in the Details, dated Jun. 2010, 4 pages.
Southern Research et al., "AIMTech Project Brief", Oct. 20, 2015, 2 pages.
Southern Research et al., "Resist Force-Induced Treadmill", 2 pages.
Speedfit LLC's Opening Claim Construction Brief, *Speedfit LLC and Aurel A. Astilean* v. *Woodway USA, Inc.,* Docket No. 2:17-cv-00768-KAM-AKT, Mar. 26, 2018, 9 pages.
Speedfit, video produced to Woodway at least by Apr. 28, 2015 in litigation, which is submitted herewith on DVD, *Speedfit LLC and Aurel A. Astilean* v. *Woodway USA, Inc.*
Speedfit, video produced to Woodway at least by Nov. 10, 2014 in litigation, *Speedfit LLC and Aurel A. Astilean* v. *Woodway USA, Inc.,* No. 2:13-cv-01276-KAM-AKT, 21 pages of screenshot excerpts.
Speedfit, video produced to Woodway at least by Nov. 10, 2014 in litigation, *Speedfit LLC and Aurel A. Astilean* v. *Woodway USA, Inc.,* No. 2:13-cv-01276-KAM-AKT, 23 pages of screenshot excerpts.
Supplemental Complaint filed Feb. 10, 2017 between *Speedfit LLC and Aurel Astilean* versus *Woodway USA, Inc.*
Supplemental Declaration of Kadie M. Jelenchick filed June 6.
Supplemental declaration of Matthew W. Peters, Case 2:13-cv-01276-KAM-AKT, Document 227, filed Aug. 8, 2018, 1 pg.
Supplemental Expert Report of Kim B. Blair, PhD., Case 3:15-CV-01665-JCH, Document 184-8, filed Mar. 16, 2018, 19 pps., marked on its face as Exhibit AA.
Supplemental rebuttal expert report of Dr. Robert Giachetti responsive to second supplemental expert report of Dr. Kim Blair dated Apr. 13, 2018, Case 3:15-CV-01665-JCH, Document 254-4, filed Jun. 8, 2018, 18 pps., marked on its face as Exhibit 4.
Supplemental rebuttal expert report of Dr. Robert Giachetti responsive to supplemental expert report of Dr. Kim Blair dated Mar. 15, 2018, dated May 14, 2018, 12 pps.
Tecmachine, "Sprint Club: User's Guide", believed to have published 2002, 33 pages.
The Australian Competition & Consumer Commission's Mandatory Satety standard For Treadmills (Supplier Guide), 2009, 20 pps.
The Woodway Force Brochure, The Best Way to Train for Speed & Athletic Power, dated May 5, 2005, 2 pages.
Third Amended Complaint filed Oct. 23, 2015 between *Speedfit LLC and Aurel Astilean* versus *Woodway USA, Inc.* and Exhibits A-H.
Transcript of civil cause for evidentiary hearing before the Honorable Kiyo A. Matsumoto, United States District Judge, Case 2:13-cv-01276-KAM-AKT, Document 213-4, filed Aug. 8, 2018, 10 pps., marked on its face as Exhibit D.
Transcript of civil cause for evidentiary hearing before the Honorable Kiyo A. Matsumoto, United States District Judge, Case 2:13-cv-01276-KAM-AKT, Document 227-3, filed Aug. 8, 2018, 5 pps., marked on its face as Exhibit G.
Transcript of videotaped deposition of Alex Astilean taken Jul. 10, 2018 for Case 2:17-cv-00768-KAM-AKT, 75 pps.
Transcript of videotaped deposition of Dan Bostan, Case 2:13-cv-01276-KAM-AKT, Document 227-2, filed Aug. 8, 2018, 4 pps., marked on its face as Exhibit F.
Transcript of videotaped deposition of Speedfit LLC by Alex Astilean taken Jul. 10, 2018 for Case 2:17-cv-00768-KAM-AKT, 38 pps.
Video deposition transcript of James D. Whelan taken on Sep. 28, 2015, Case 2:13-cv-01276-KAM-AKT, Document 213-1, filed Aug. 8, 2018, 23 pps., marked on its face as Exhibit A.
Woodway USA, Inc., "Treadmill Owner's Manual", Oct. 2001, 56 pages.
Woodway USA, Inc., EcoMill Promotional Flyer, Oct. 18, 2011, 1 page.
Woodway USA, Inc., Owner's Manual: EcoMill Non-Motorized, Jun. 4, 2010, 35 pages.
Woodway USA, Inc.'s Amended Supplemental Counterclaims, Case 3:15-CV-01665-JCH, Document 309, filed Sep. 14, 2018, 28 pps.
Woodway USA, Inc.'s Answer, Affirmative Defenses, and Counterclaims to Plaintiffs' First Amended Complaint filed Oct. 24, 2014 and Exhibits 1 and 2.

(56) References Cited

OTHER PUBLICATIONS

Woodway USA, Inc.'s Answer, Affirmative Defenses, and Counterclaims to Plaintiffs' Second Amended Complaint filed Mar. 6, 2015, 17 pages.
Woodway USA, Inc.'s Answer, Affirmative Defenses, and Counterclaims to Plaintiffs' Supplemental Complaint filed Feb. 24, 2017, 18 pages.
Woodway USA, Inc.'s first supplemental responses and objections to plaintiff's first set of interrogatories (Nos. 1-7), Case 2:17-CV-00768-KAM-AKT, Document 38-1, filed Mar. 14, 2018, 18 pps., marked on its face as Exhibit A.
Woodway USA, Inc.'s List of Claim Terms to be Considered and Proposed Constructions, *Speedfit LLC and Aurel A. Astilean* v. *Woodway USA, Inc.,* Docket No. 2:17-cv-00768-KAM-AKT, Exhibit D, Mar. 26, 2018, 4 pages.
Woodway USA, Inc.'s local rule 56(a)1 statement of undisputed material facts in support of its motion summary judgment of infringement of U.S. Pat. No. 9,039,580, Case 3:15-CV-01665-JCH, Document 257, 8 pps.
Woodway USA, Inc.'s local rule 56(a)2 statement of facts in opposition to plaintiffs' motion for summary judgment, Case 3:15-CV-01665-JCH, Document 267, filed Jun. 29, 2018, 34 pps.
Woodway USA, Inc.'s Memorandum in response to Plaintiffs' Motion for Leave to Amend the Second Amended Complaint filed Jul. 7, 2015, 16 pages.
Woodway USA, Inc.'s Memorandum in Response to Plaintiffs' Motion Under 35 USC 256 to Correct Inventorship of U.S. Pat. No. 8,308,619 and U.S. Pat. No. 8,342,016 filed Jun. 15, 2015, 20 pages.
Woodway USA, Inc.'s memorandum in support of its motion to preclude the testimony of plaintiffs' technical expert James Whelan, Case 2:13-cv-01276-KAM-AKT, Document 212, filed Aug. 8, 2018, 37 pps.
Woodway USA, Inc.'s memorandum of law in opposition to plaintiffs' motion for summary judgment of non-infringement and invalidity of Claim 25 of U.S. Pat. No. 9,039,580, Case 3:15-CV-01665-JCH, Document 266, filed Jun. 29, 2018, 42 pps.
Woodway USA, Inc.'s Memorandum of Law in support of its motion for summary judgment of infringement of U.S. Pat. No. 9,039,580, Case 3:15-CV-01665-JCH, Document 256, 38 pps.
Woodway USA, Inc.'s Memorandum of Law in Support of Its Motions for Summary Judgment of Invalidity of U.S. Pat. No. 8,308,619 and 8,343,016 and Opening Claim Construction Brief filed Jun. 6, 2017, 38 pages.
Woodway USA, Inc.'s motion for summary judgment of infringement of U.S. Pat. No. 9,039,580, Case 3:15-CV-01665-JCH, Document 255, filed Jun. 8, 2018, 3 pps.
Woodway USA, Inc.'s Opening Claim Construction Brief, *Speedfit LLC and Aurel A. Astilean* v. *Woodway USA, Inc.,* Docket No. 2:17-cv-00768-KAM-AKT, Mar. 26, 2018, 15 pages.
Woodway USA, Inc.'s opposition to plaintiffs' motion for partial reconsideration, Case 3:15-CV-01665-JCH, Document 250, filed May 14, 2018, 19 pps.
Woodway USA, Inc.'s Patents, *Speedfit LLC and Aurel A. Astilean* v. *Woodway USA, Inc.,* Docket No. 2:17-cv-00768-KAM-AKT, Exhibit B, Mar. 26, 2018, 3 pages.
Woodway USA, Inc.'s Reply Claim Construction Brief, *Speedfit LLC and Aurel A. Astilean* v. *Woodway USA, Inc.,* Docket No. 2:17-cv-00768-KAM-AKT, Mar. 26, 2018, 9 pages.
Woodway USA, Inc.'s reply memorandum in further support of its motion to preclude the testimony of Plaintiffs' technical expert James Whelan, Case 2:13-cv-01276-KAM-AKT, Document 226, filed Aug. 8, 2018, 16 pps.
Woodway USA, Inc.'s Reply Memorandum in Support of Its Motion to Dismiss filed Nov. 25, 2015, 24 pages.
Woodway USA, Inc.'s Responsive Claim Construction Brief filed Jul. 28, 2017, 19 pages.
Woodway, "Introducing the All New EcoMill Self Powered", published to YouTube on Mar. 25, 2010, https://www.youtube.com/watch?v=NcPH92DAArc.
Woodway, Curve 3.0 Specification, May 25, 2011, 1 page.
Woodway, Curve Specification, May 24, 2011, 1 page.
Woodway, Curve Specification, May 25, 2011, 1 page.
Woodway, Curve XL Specification, May 18, 2011, 1 page.
Woodway, Force Specification, Apr. 8, 2008, 1 page.
Woodway, Force Specification, May 2, 2011, 1 page.
Woodway, Force Specification, May 2, 2012, 1 page.
Woodway's USA, Inc.'s Reply in Support of its Motion for Summary Judgment of Invalidity of U.S. Pat. Nos. 8,308,619 and 8,343,016 and Reply Claim Construction Brief filed Jun. 6, 2017, 16 pages.
Woodway's Opposition to Defendant's Notice of Motion and Motion to Dismiss Case and Transfer Litigation to EDNY, *Woodway USA, Inc.* v. *Aurel A. Astilean,* Civ. Dkt. No. 2:13-cv-00681-WERC (E.D. WI), Oct. 18, 2013, 22 pages.
Woodways USA, Inc.'s Supplemental Rule 56.1 Statement of Undisputed Material Facts and Responses to Rule 56.1 Counterstatement by Plaintiffs Speedfit LLC and Aurel A. Astilean filed Jun. 6, 2017, 20 pages.
Sears, Roebuck and Co., 1986 Spring Summer Centennial Edition Catalog, Jan. 1, 1985, Curved Exerciser models 1 and 2 on pp. 496 and 497.
Woodway, "Curve Trainer", Sep. 2, 2020, https://www.woodway.com/products/curve-trainer/, p. 1.

* cited by examiner

TREADMILL WITH ELECTROMECHANICAL BRAKE

CROSS-REFERENCE TO RELATED PATENT APPLICATIONS

This application is a Continuation of U.S. patent application Ser. No. 15/966,598, filed Apr. 30, 2018, which is a Continuation of U.S. patent application Ser. No. 14/941,342, filed Nov. 13, 2015, which is a Continuation of U.S. patent application Ser. No. 14/517,478, filed Oct. 17, 2014, which is a Continuation of U.S. patent application Ser. No. 13/257,038, filed Sep. 16, 2011, which is a National Stage Entry of International Application No. PCT/US2010/026731, filed Mar. 9, 2010, which claims priority to and the benefit of U.S. Provisional Application Ser. No. 61/161,027, filed Mar. 17, 2009, all of which are incorporated herein by reference in their entireties.

BACKGROUND

The present invention relates generally to the field of treadmills. More specifically, the present invention relates to manual treadmills. Treadmills enable a person to walk, jog, or run for a relatively long distance in a limited space. It should be noted that throughout this document, the term "run" and variations thereof (e.g., running, etc.) in any context is intended to include all substantially linear locomotion by a person. Examples of this linear locomotion include, but is not limited to, jogging, walking, skipping, scampering, sprinting, dashing, hopping, galloping, etc.

A person running generates force to propel themselves in a desired direction. To simplify this discussion, the desired direction will be designated as the forward direction. As the person's feet contact the ground (or other surface), their muscles contract and extend to apply a force to the ground that is directed generally rearward (i.e., has a vector direction substantially opposite the direction they desire to move). Keeping with Newton's third law of motion, the ground resists this rearwardly directed force from the person, resulting in the person moving forward relative to the ground at a speed related to the force they are creating.

To counteract the force created by the treadmill user so that the user stays in a relatively static fore and aft position on the treadmill, most treadmills utilize a belt that is driven by a motor. The motor operatively applies a rotational force to the belt, causing that portion of the belt on which the user is standing to move generally rearward. This force must be sufficient to overcome all sources of friction, such as the friction between the belt and other treadmill components in contact therewith and kinetic friction, to ultimately rotate the belt at a desired speed. The desired net effect is that, when the user is positioned on a running surface of the belt, the forwardly directed velocity achieved by the user is substantially negated or balanced by the rearwardly directed velocity of the belt. Stated differently, the belt moves at substantially the same speed as the user, but in the opposite direction. In this way, the user remains at substantially the same relative position along the treadmill while running. It should be noted that the belts of conventional, motor-driven treadmills must overcome multiple, significant sources of friction because of the presence of the motor and configurations of the treadmills themselves.

Similar to a treadmill powered by a motor, a manual treadmill must also incorporate some system or means to absorb or counteract the forward velocity generated by a user so that the user may generally maintain a substantially static position on the running surface of the treadmill. The counteracting force driving the belt of a manual treadmill is desirably sufficient to move the belt at substantially the same speed as the user so that the user stays in roughly the same static position on the running surface. Unlike motor-driven treadmills, however, this force is not generated by a motor.

For most treadmill applications, it is desirable to integrate electrical components which provide feed back and data performance analysis such as speed, time, distance, calories burned, heart rate, etc. However, a manually operated treadmill which does not integrate a motor to drive the running belt may not incorporate a connection to a conventional electrical power source. Alternatively, it may be desirable to use the manually operated treadmill a relatively long distance from a conventional power source. For a whole host of environmental and practical reasons, there may be some benefit to creating a treadmill which is manually operated, but integrates a power generator to provide the necessary electrical power for operation of the treadmill or alternatively to generate power for the operation of other electrically powered products.

SUMMARY

One embodiment of the invention relates to a manually operated treadmill adapted to generate electrical power comprising a treadmill frame, a running belt supported upon the treadmill frame and adapted for manual rotation, and an electrical power generator mechanically interconnected to the running belt and adapted to convert the manual rotational motion of the running belt into electrical power.

Another embodiment of the invention relates to a treadmill comprising a treadmill frame; a support member rotationally supported upon the treadmill frame; a running belt supported by and interconnected to the support member, the running belt being mounted solely for manual rotation about the support member; an electrical power generator adapted to convert rotational movement into electrical power; and a power transfer belt mounted to interconnect the electrical power generator to the support member so that the rotational movement of the support member is transferred to the electrical power generator which in turn creates electrical power.

Another embodiment of the invention relates to a method of providing power to a treadmill comprising the steps of providing a treadmill frame, a support member rotationally supported upon the treadmill frame, a running belt supported by and interconnected to the support member, the running belt being mounted solely for manual rotation about the support member, an electrical power generator supported on the treadmill frame being adapted to convert rotational movement into electrical power, a power transfer belt adapted to interconnect the electrical power generator and the support member so that the rotational movement of the support member is transferred to the electrical power generator which in turn creates electrical power; and an electrical display panel being adapted to calculate and display performance data relating to operation of the treadmill. The invention further comprises the step of electrically interconnecting the electrical power generator to a display panel so that the electrical power necessary to operate the electrical display panel is supplied by the power generator.

DETAILED DESCRIPTION

Figure 1:
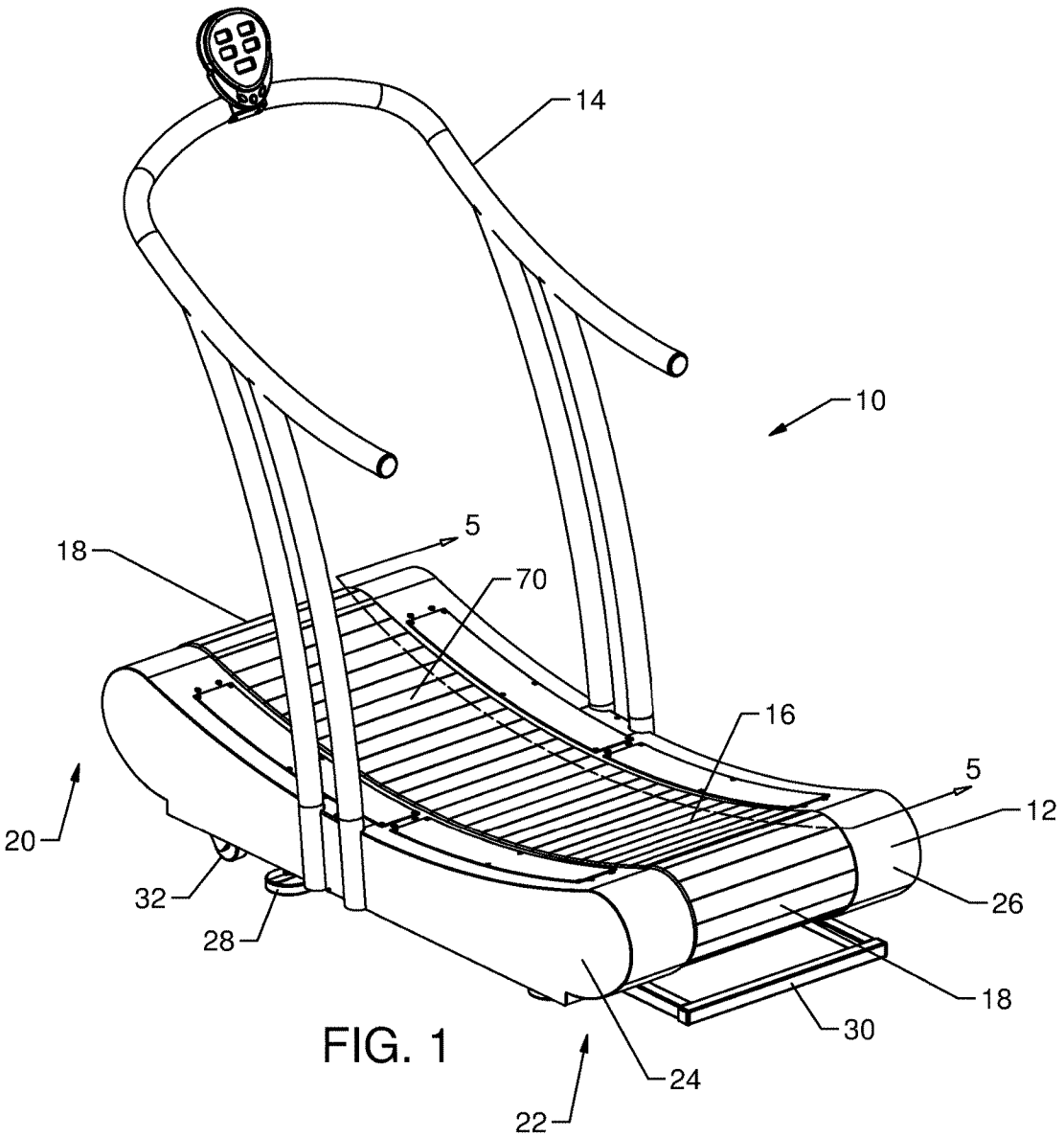
FIG. 1 is a perspective view of an exemplary embodiment of a manual treadmill having a non-planar running surface.
Figure 2:
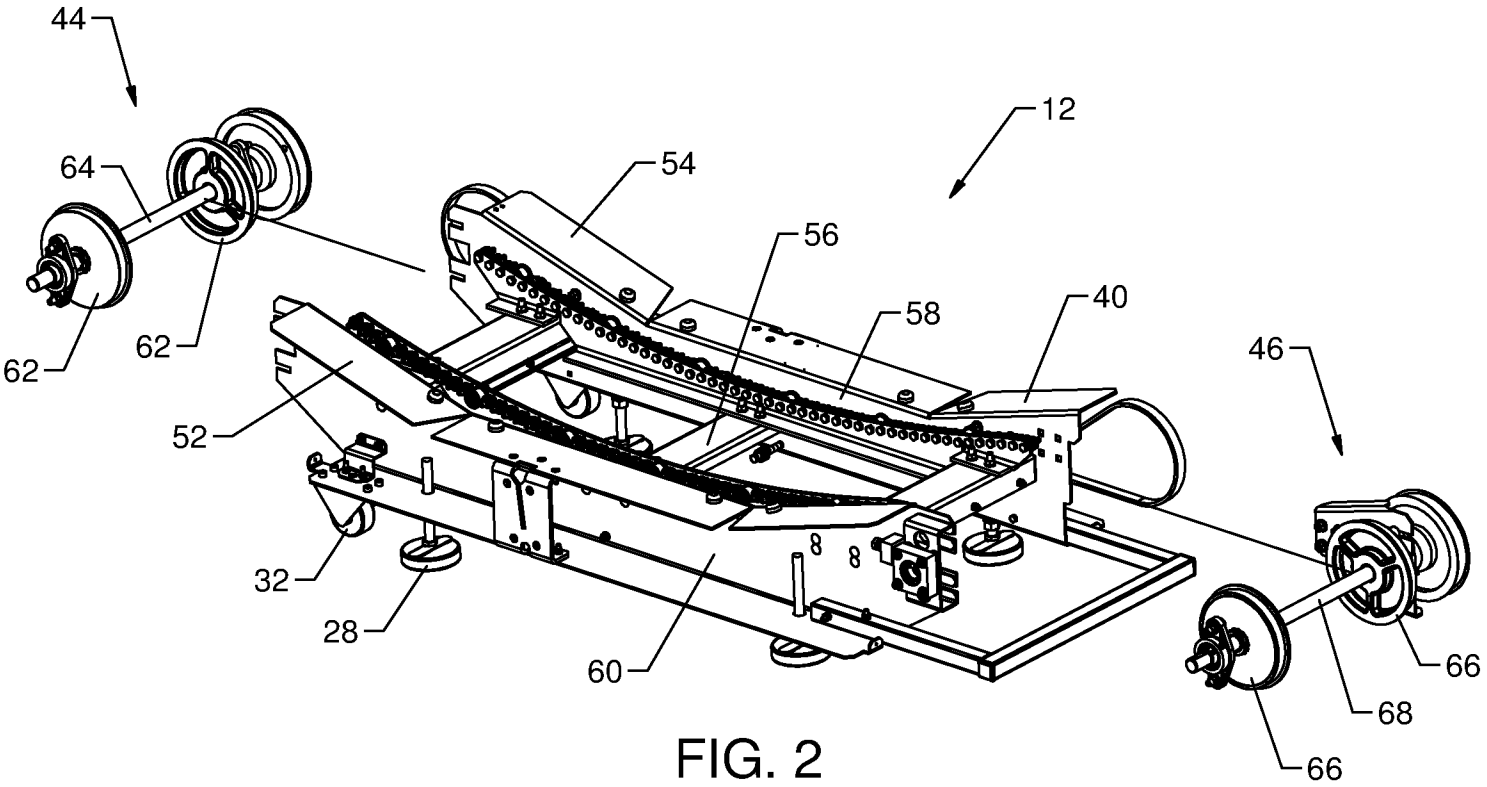
FIG. 2 is a left-hand partially exploded perspective view of a portion of the manual treadmill according to the exemplary embodiment shown in FIG. 1.
Figure 3:
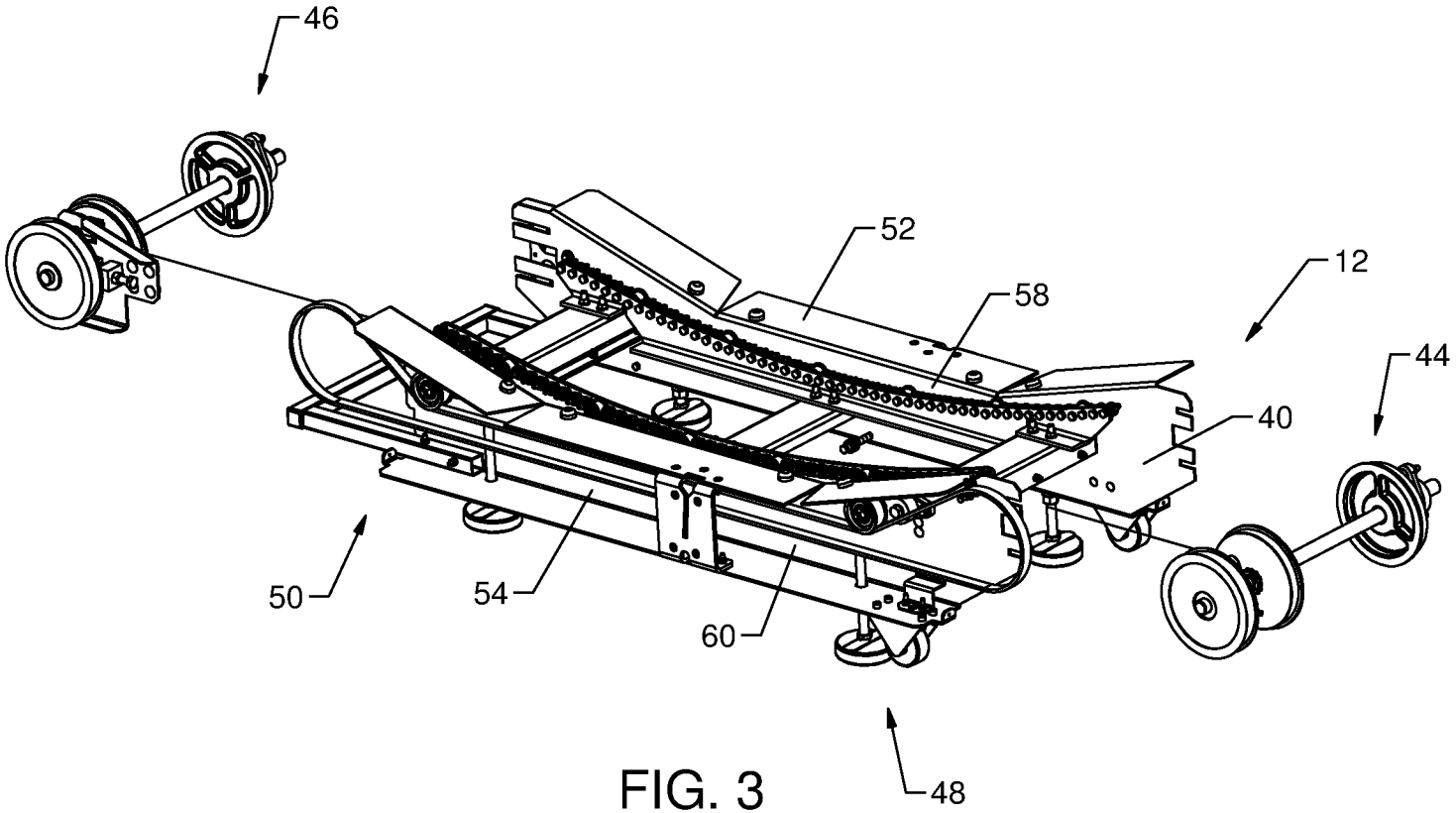
FIG. 3 is a right-hand partially exploded perspective view of a portion of the manual treadmill according to the exemplary embodiment shown in FIG. 1.

Referring to FIG. 1, a manual treadmill 10 generally comprises a base 12 and a handrail 14 mounted to the base 12 as shown according to an exemplary embodiment. The base 12 includes a running belt 16 that extends substantially longitudinally along a longitudinal axis 18. The longitudinal axis 18 extends generally between a front end 20 and a rear end 22 of the treadmill 10; more specifically, the longitudinal axis 18 extends generally between the centerlines of a front shaft and a rear shaft, which will be discussed in more detail below.

A pair of side panels 24 and 26 (e.g., covers, shrouds, etc.) are provided on the right and left sides of the base 12 to effectively shield the user from the components or moving parts of the treadmill 10. The base 12 is supported by multiple support feet 28, which will be described in greater detail below. A rearwardly extending handle 30 is provided on the rear end of the base 12 and a pair of wheels 32 are provided at the front end of the base 12, however, the wheels 32 are mounted so that they are generally not in contact with the ground when the treadmill is in an operating position. The user can easily move and relocate the treadmill 10 by lifting the rear of the treadmill base 12 a sufficient amount so that the multiple support feet 28 are no longer in contact with the ground, instead the wheels 32 contact the ground, thereby permitting the user to easily roll the entire treadmill 10. It should be noted that the left and right-hand sides of the treadmill and various components thereof are defined from the perspective of a forward-facing user standing on the running surface of the treadmill 10.

Referring to FIGS. 2-6, the base 12 is shown further including a frame 40, a front shaft assembly 44 positioned near a front portion 48 of the frame 40, and a rear shaft assembly 46 positioned near the rear portion 50 of frame 40, generally opposite the front portion 48. Specifically, the front shaft assembly 44 is coupled to the frame 40 at the front portion 48, and the rear shaft assembly 46 is coupled to the frame 40 at the rear portion 48 so that the frame supports these two shaft assemblies.

The frame 40 comprises longitudinally-extending, opposing side members, shown as a left-hand side member 52 and a right-hand side member 54, and one or more lateral or cross-members 56 extending between and structurally connecting the side members 52 and 54 according to an exemplary embodiment. Each side member 52, 54 includes an inner surface 58 and an outer surface 60. The inner surface 58 of the left-hand side member 52 is opposite to and faces the inner surface 58 of the right-hand side member 54. According to other exemplary embodiments, the frame may have substantially any configuration suitable for providing structure and support for the manual treadmill.

Similar to most motor-driven treadmills, the front shaft assembly 44 includes a pair of front running belt pulleys 62 interconnected with, and preferably directly mounted to, a shaft 64, and the rear shaft assembly 46 includes a pair of rear running belt pulleys 66 interconnected with, and preferably directly mounted to, a shaft 68. The front and rear running belt pulleys 62, 66 are configured to support and facilitate movement of the running belt 16. The running belt 16 is disposed about the front and rear running belt pulleys 62, 66, which will be discussed in more detail below. As the front and rear running belt pulleys 62, 66 are preferably fixed relative to shafts 64 and 68, respectively, rotation of the front and rear running belt pulleys 62, 66 causes the shafts 64, 68 to rotate in the same direction.

As noted above, the manual treadmill disclosed herein incorporates a variety of innovations to translate the forward force created by the user into rotation of the running belt and permit the user to maintain a substantially static fore and aft position on the running belt while running. One of the ways to translate this force is to configure the running belt 16 to be more responsive to the force generated by the user. For example, by minimizing the friction between the running belt 16 and the other relevant components of the treadmill 10, more of the force the user applies to the running belt 16 to propel themselves forward can be utilized to rotate the running belt 16.

Another way to counteract the user-generated force and convert it into rotational motion of the running belt 16 is to integrate a non-planar running surface, such as non-planar running surface 70. Depending on the configuration, non-planar running surfaces can provide a number of advantages. First, the shape of the non-planar running surface may be such that, when a user is on the running surface, the force of gravity acting upon the weight of the user's body helps rotate the running belt. Second, the shapes may be such that it creates a physical barrier to restrict or prevent the user from propelling themselves off the front end 20 of the treadmill 10 (e.g., acting essentially as a stop when the user positions their foot thereagainst, etc.). Third, the shapes of some of the non-planar running surfaces can be such that it facilitates the movement of the running belt 16 there along (e.g., because of the curvature, etc.). Accordingly, the force the user applies to the running belt 16 is more readily able to be translated into rotation of the running belt 16.

Figure 4:
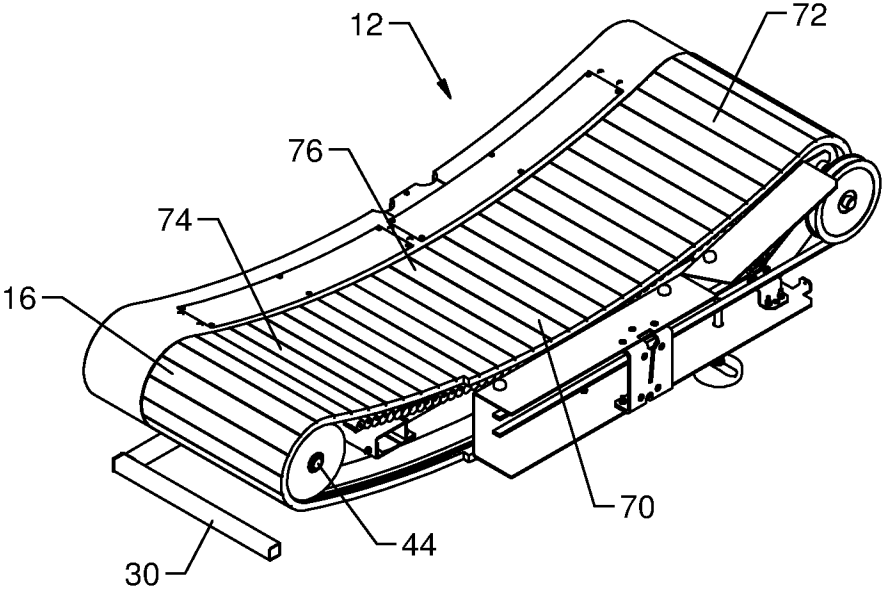
FIG. 4 is a partial side elevational view of the manual treadmill of FIG. 1 with a portion of the treadmill cut-away to show a portion of the arrangement of elements.
Figure 5:
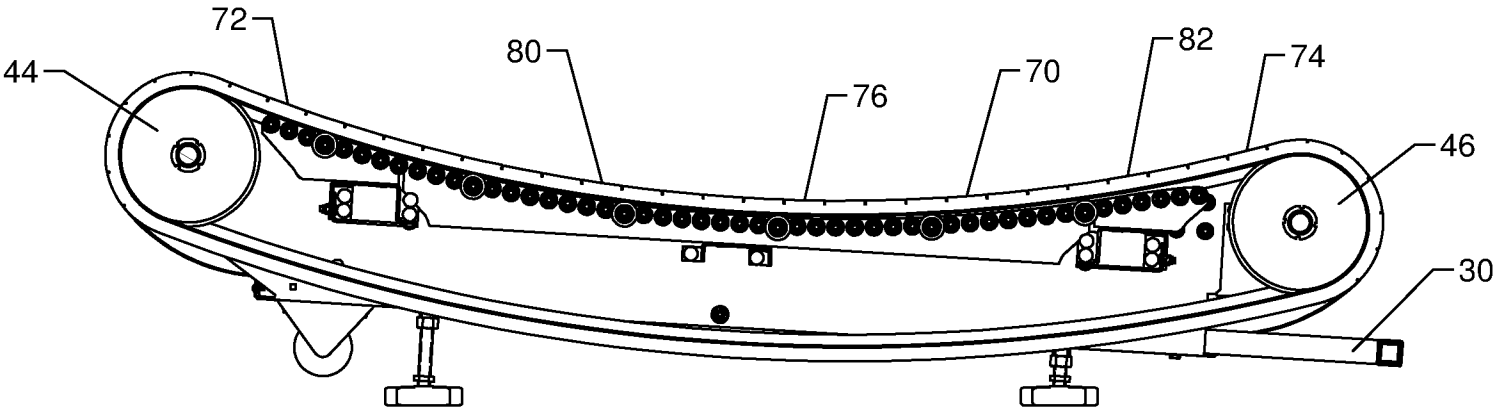
FIG. 5 is a cross-sectional view of a portion of the manual treadmill taken along line 5-5 of FIG. 1.
Figure 6:
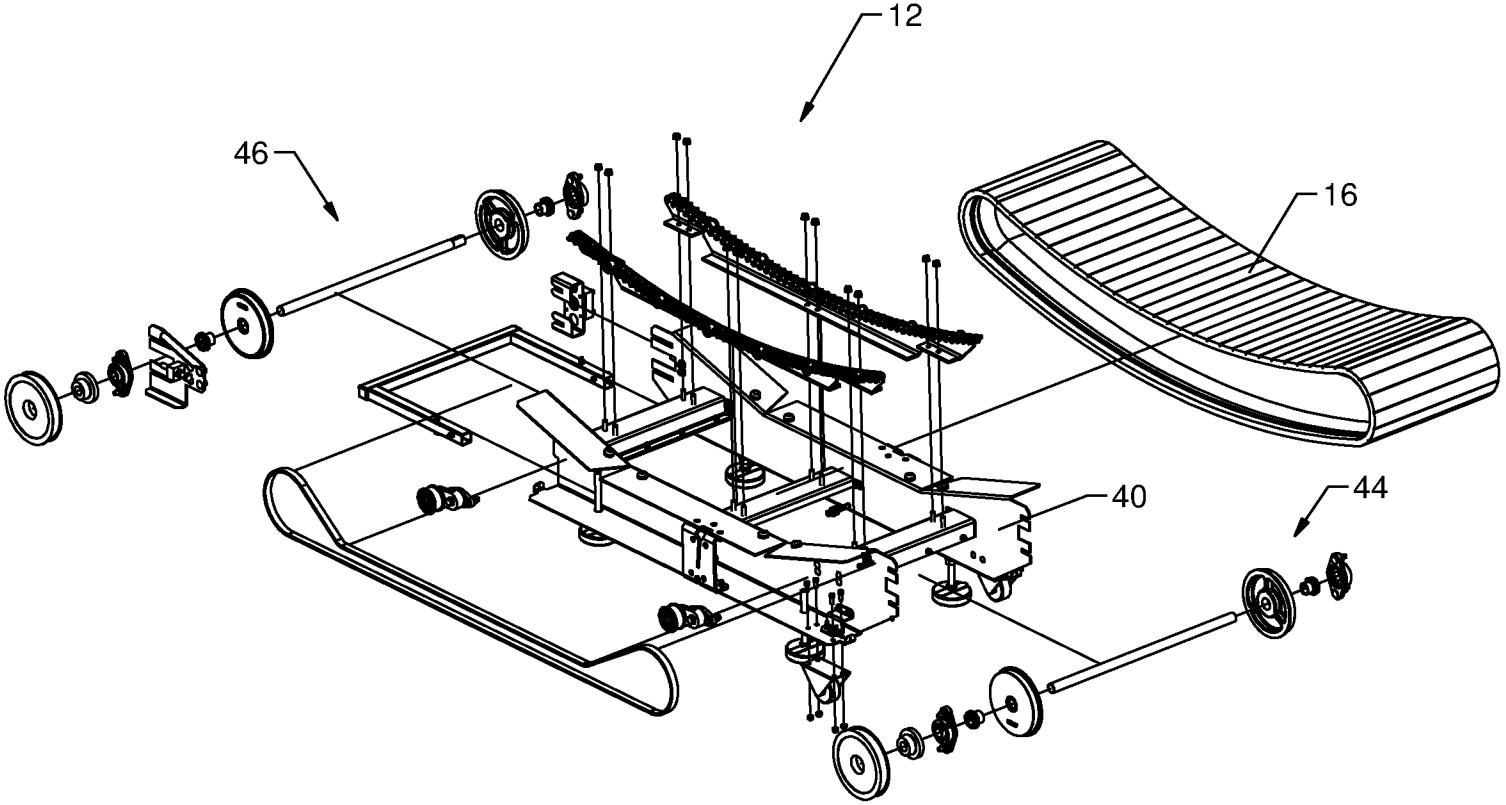
FIG. 6 is an exploded view of a portion of the manual treadmill of FIG. 1 having the side panels and handrail removed.

As seen in FIGS. 1 and 4-5, the running surface 70 is generally non-planar and shown shaped as a substantially complex curve according to an exemplary embodiment. The running surface can be generally divided up into three general regions, the front portion 72, which is adjacent to the front shaft assembly 44, the rear portion 74, which is adjacent to the rear shaft assembly 46, and the central portion 76, which is intermediate the front portion 72 and the rear portion 74. In the exemplary embodiment seen in FIGS. 1 and 4, the running surface 70 includes a substantially concave curve 80 and a substantially convex curve 82. At the front portion 72 of the running surface 70, the relative height or distance of the running surface 70 relative to the ground is generally increasing moving forward along the longitudinal axis 18 from the central portion 76 toward the front shaft assembly 44. This increasing height configuration provides one structure to translate the forward running force generated by the user into rotation of the running belt 16. To initiate the rotation of the running belt 16, the user places her first foot at some point along the upwardly-inclined front portion 72 of the running surface 70. As the weight of the user is transferred to this first foot, gravity exerts a downward force on the user's foot and causes the running belt 16 to move (e.g., rotate, revolve, advance, etc.) in a generally clockwise direction as seen in FIG. 1 (or counterclockwise as seen in FIG. 4). As the running belt 16 rotates, the user's first foot will eventually reach the lowest point in the non-planar running surface 70 found in the central portion 76, and, at that point, gravity is substantially no longer available as a counteracting source to the user's forward running force. Assuming a typical gait, at this point the user will place her second foot at some point along the upwardly-inclined front portion 72 of the running belt 16 and begin to transfer weight to this foot. Once again, as weight shifts to this second foot, gravity acts on the user's foot to continue the rotation of the running belt 16 in the clockwise direction as seen in FIG. 1. This process merely repeats itself each and every time the user places her weight-bearing foot on the running belt 16 at any position vertically above the lowest point of central portion 76 of the running surface 70 of the of the running belt 16. The upwardly-inclined front portion 72 of the running belt 16 also acts substantially as a physical stop, reducing the chance the user can inadvertently step off the front end 20 of the treadmill 10.

A user can generally control the speed of the treadmill 10 by the relative placement of her weight-bearing foot along the running belt 16 of the base 12. Generally, the rotational speed of the running belt 16 increases as greater force is applied thereto in the rearward direction. The generally upward-inclined shape of the front portion 72 thus provides an opportunity to increase the force applied to the running belt 16, and, consequently, to increase the speed of the running belt 16. For example, by increasing her stride and/or positioning her weight-bearing foot vertically higher on the front portion 72 relative to the lowest portion of the running belt 16, gravity will exert a greater and greater amount of force on the running belt 16 to drive it rearwardly. In the configuration of the running belt 16 seen in FIG. 1, this corresponds to the user positioning her foot closer to the front end 20 of the treadmill 10 along the longitudinal axis 18. This results in the user applying more force to the running belt 16 because gravity is pulling her mass downward along a greater distance when her feet are in contact with the front portion 72 of the running surface 70. As a result, the relative rotational speed of the belt 16 and the relative running speed the user experiences is increased.

Another factor which will increase the speed the user experiences on the treadmill 10 is the relative cadence the user assumes. As the user increases her cadence and places her weight-bearing foot more frequently on the upwardly extending front portion 72, more gravitational force is available to counteract the user-generated force, which translates into greater running speed for the user on the running belt 16. It is important to note that speed changes in this embodiment are substantially fluid, substantially instantaneous, and do not require a user to operate electromechanical speed controls. The speed controls in this embodiment are generally the user's cadence and relative position of her weight-bearing foot on the running surface. In addition, the user's speed is not limited by speed settings as with a driven treadmill.

In the embodiment seen in FIGS. 1-6, gravity is also utilized as a means for slowing the rotational speed of the running belt. At a rear portion 74 of the running surface 70, the distance of the running surface 70 relative to the ground generally increases moving rearward along the longitudinal axis 18 from the lowest point in the non-planar running surface 70. As each of the user's feet move rearward during her stride, the rear portion 74 acts substantially as a physical stop to discourage the user from moving too close to the rear end of the running surface. To this point, the user's foot has been gathering rearward momentum while moving from the front portion 72, into the central portion 76, and toward the rear portion 74 of the running surface 70. Accordingly, the user's foot is exerting a significant rearwardly-directed force on the running belt 16. Under Newton's first law of motion, the user's foot would like to continue in the generally rearward direction. The upwardly-inclined rear portion 74, interferes with this momentum and provides a force to counter the rearwardly-directed force of the user's foot by providing a physical barrier. As the user's non-leading foot moves up the incline, the running surface 70 provides a force that counters the force of the user's foot, absorbing some of the rearwardly-directed force from the user and preventing it from being translated into increasing speed of the running belt 16. Also, gravity acts on the user's weight bearing foot as it moves upward, exerting a downwardly-directed force on the user's foot that the user must counter to lift their foot and bring it forward to continue running. In addition to acting as a stop, the rear portion 74 provides a convenient surface for the user to push off of when propelling themselves forward, the force applied by the user to the rear portion 74 being countered by the force the rear portion 74 applies to the user's foot.

One benefit of the manual treadmill according to the innovations described herein is positive environmental impact. A manual treadmill such as that disclosed herein does not utilize electrical power to operate the treadmill or generate the rotational force on the running belt. Therefore, such a treadmill can be utilized in areas distant from an electrical power source, conserve electrical power for other uses or applications, or otherwise reduce the "carbon footprint" associated with the operation of the treadmill.

A manual treadmill according to the innovations disclosed herein can incorporate one of a variety of shapes and complex contours in order to translate the user's forward force into rotation of the running belt or to provide some other beneficial feature or element. FIGS. 1 and 4-5, generally depict the curve defined by the running surface 70, specifically, substantially a portion of a curve defined by a third-order polynomial equation. The front portion 72 and the central portion 76 define the concave curve 80 and the rear portion 74 of the running surface 70 defines the convex curve 82. As the central portion 76 of the running surface 70 transitions to the rear portion 74, the concave curve transitions to the convex curve. In the embodiment shown, the curvature of the front portion 72 and the central portion 76 is substantially the same; however, according to other exemplary embodiments, the curvature of the front portion 72 and the central portion 76 may differ.

According to an exemplary embodiment, the relative length of each portion of the running surface may vary. In the exemplary embodiment shown, the central portion is the longest. In other exemplary embodiments, the rear portion may be the longest, the front portion may be shorter than the intermediate portion, or the front portion may be longer than the rear portion, etc. It should be noted that the relative length may be evaluated based on the distance the portion extends along the longitudinal axis or as measured along the surface of the running belt itself.

One of the benefits of integrating one or more of the various curves or contours into the running surface is that the contour of the running surface can be used to enhance or encourage a particular running style. For example, a curve integrated into the front portion of the running surface can encourage the runner to run on the balls of her feet rather than a having the heel strike the ground first. Similarly, the contour of the running surface can be configured to improve a user's running biomechanics and to address common running induced injuries (e.g., plantar fasciitis, shin splints, knee pain, etc.). For example, integrating a curved contour on the front portion of the running surface can help to stretch the tendons and ligaments of the foot and avoid the onset of plantar fasciitis.

A conventional treadmill which uses an electrical motor to provide the motive force to rotate a running belt consumes electrical energy. However, a treadmill which is adapted to manually provide the motive force to rotate the running belt has the capability of generating electrical power by tapping into the motion of the running belt. FIGS. 7-10 show the treadmill 10 adapted to generate electrical power according to an exemplary embodiment.

In an exemplary embodiment of the innovations disclosed herein, a power generation system 100 comprises a drive pulley 102 preferably interconnected to the running belt 16, a power transfer belt 104 interconnected to the drive pulley 102, a generator 106 interconnected to the drive pulley 102, an energy storage device shown as a battery 108 electrically connected to the generator 106, and a generator control board 110 electrically connected to the battery 108 and generator 106. The power generation system 100 is configured to transform the kinetic energy the treadmill user imparts to the running belt 16 to electrical power that may be stored and/or utilized to operate one or more electrically-operable devices (e.g., a display, a motor, a USB port, one or more heart rate monitoring pick-ups, a port for charging a mobile telephone or portable music device, etc.). It should be noted that, in some exemplary embodiments, energy storage devices other than batteries may be used (e.g., a capacitor, etc.).

The drive pulley 102 is coupled to a support element shown as the front shaft 64 such that the drive pulley 102 will generally move with substantially the same rotational velocity as the front shaft 64 when a user operates the treadmill 10 according to an exemplary embodiment. The power transfer belt 104 under suitable tension rotationally couples the drive pulley 102 to the generator 106, thereby mechanically interconnecting the running belt 16 and the front shaft 64 to the generator 106. The power transfer belt 104 is disposed or received at least partially about an exterior surface 112 of the drive pulley 102 and at least partially about an exterior surface 116 of an input shaft 118 of the generator 106. Accordingly, as a user imparts rotational force to the running belt 16, the running belt 16 transfers this force to the front running belt pulleys 62 and the front shaft 64 to which the front running belt pulleys 62 are mounted. Because the drive pulley 102 is mounted to the front shaft 64, this element rotates with the front shaft 64. This rotational force is transferred from the drive pulley 102 to the power transfer belt 104, which is mounted under suitable tension on the drive pulley 102, which in turn causes rotation of the generator input shaft 118. Preferably, the diameter of the drive pulley 102 is larger than the diameter of the input shaft 118 of the generator 106, so the input shaft 118 rotates with greater rotational velocity than the drive pulley 102.

While this exemplary embodiment shows the drive pulley 102 coupled to the front shaft 64, it is to be understood that the drive pulley 102 can be coupled to any part or portion of the treadmill which moves in response to the input from the user. For example, according to another exemplary embodiment, the drive pulley may be coupled to the rear shaft. According to still other exemplary embodiments, the drive pulley can be coupled to any support element that can impart motion thereto as a result of a user driving the running belt of the manual treadmill.

Figure 7:
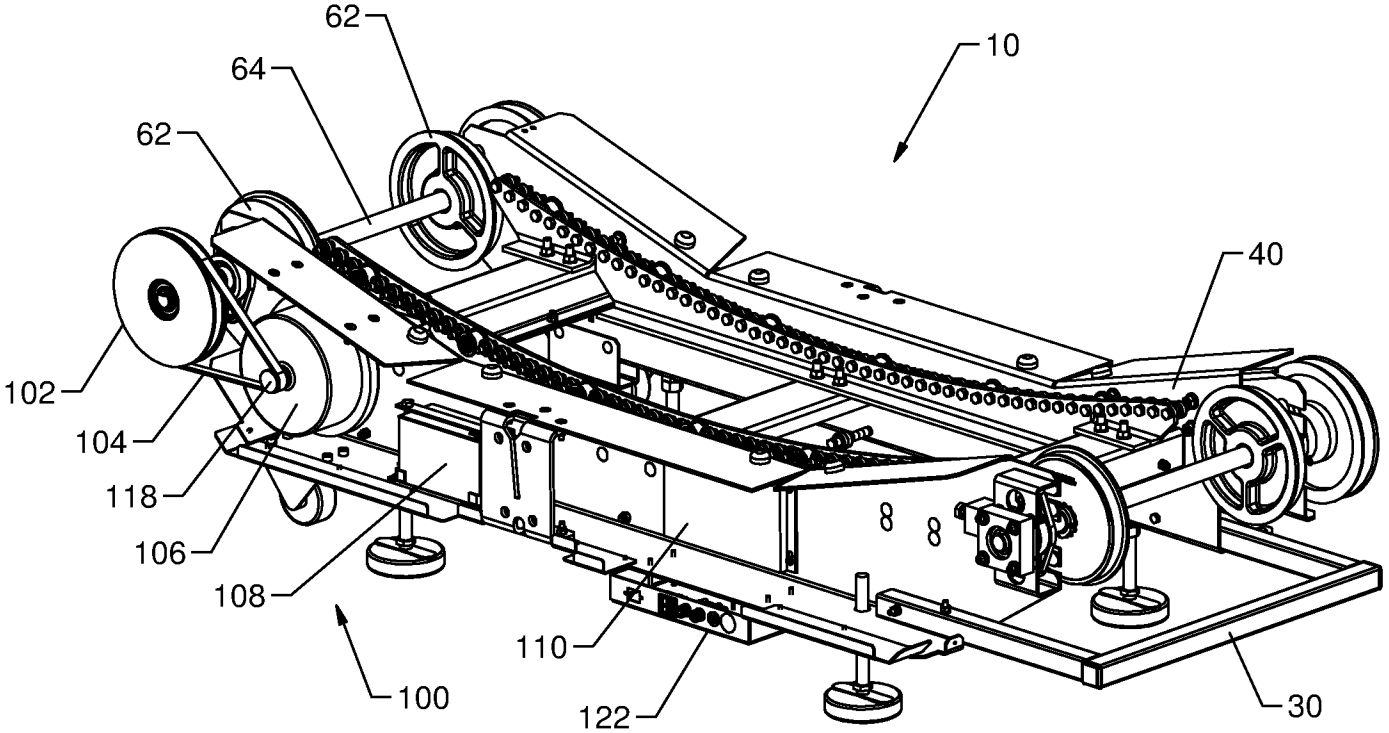
FIG. 7 is a left-hand partially exploded perspective view of a portion of the manual treadmill according to the exemplary embodiment shown in FIG. 1 including a power generation system.
Figure 8:
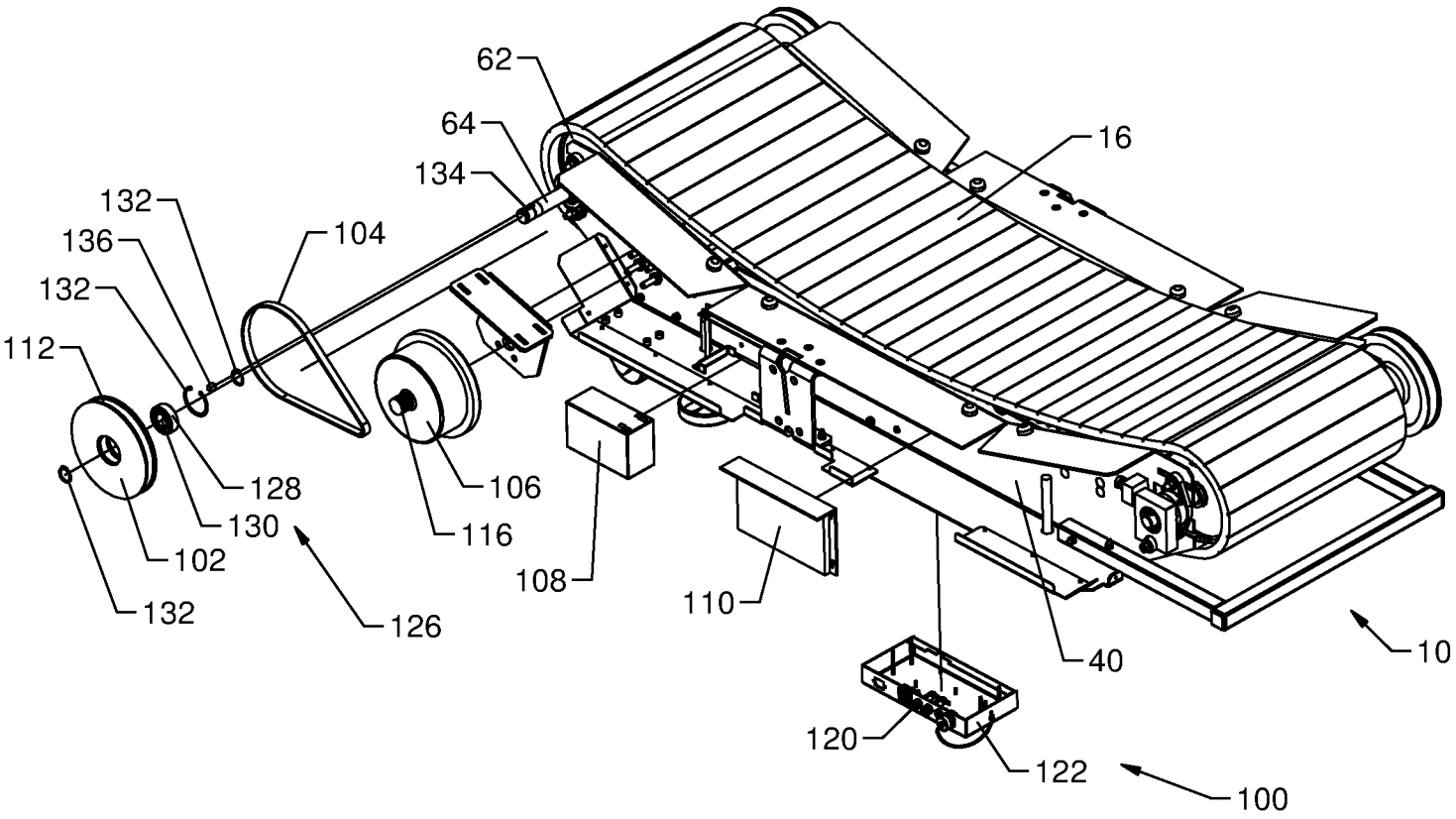
FIG. 8 is partially exploded view of a portion of the manual treadmill according to the exemplary embodiment shown in FIG. 7.

The generator 106 is electrically interconnected with the battery 108, preferably by a conventional electrical wire (not shown). The generator 106 transforms the mechanical input from the running belt 16 into electrical energy. This electrical energy, produced by the generator 106 as a result of the manual rotation of the running belt 16, is then stored in the battery 108. The battery 108 can then be used to provide power to a wide variety of electrically-operable devices such as mobile telephones, portable music players, televisions, gaming systems, or performance data display devices. The generator depicted in FIGS. 7-8 is a conventional generator such as Model 900 as manufactured by Pulse Power Systems.

The battery 108 is electrically coupled to one or more outlets or jacks 120, preferably by a conventional electrical wire (not shown), and the jacks 120 are mounted to the treadmill frame 40 by a bracket 122. One or more of the jacks 120 are configured to receive an electrical plug or otherwise output power so that electrical power may be transferred from the battery 108 to an electrically-operable device.

In use, as the user imparts rotational force to the running belt 16, this force is input into the generator 106 as a result of the cooperation of the front shaft 64, the drive pulley 102, the power transfer belt 104 and the generator input shaft 118. This rotation of the generator input shaft 118 results in the creation of electrical power which is typically input into the battery 108 if the user is traveling at a speed equal to or greater than a predetermined speed, the predetermined speed being determined by the configuration of the power generation system 100.

In order to ensure that the rotational momentum inherent in the mass of the generator does not adversely impact the user's variable speed of rotation of the running belt 16 (and vice-versa), a motion restricting element shown as a one-way bearing 126 is preferably coupled to or incorporated with the power generator system 100 according to an exemplary embodiment. The one-way bearing 126 is configured to permit rotation of the drive pulley 102 in only one direction. The one-way bearing 126 is shown press fit into the drive pulley 102, having an inner ring 128 fixed relative to the front shaft 64 and an outer ring 130 fixed relative to the drive pulley 102. One or more snap rings 132 are provided to establish the side-to-side location of the drive pulley 102 and one-way bearing 126 along the front shaft 64, though, securing elements other than or in addition to the snap rings may also be used. According to other exemplary embodiments, the motion-restricting element may be any suitable motion-restricting element (e.g., a cam system, etc.).

The front shaft 64 further includes a keyway 134 formed therein that cooperates with a key 136 of the one-way bearing 126 to help impart the motion of the front shaft 64 to the drive pulley 102 according to an exemplary embodiment. As a user imparts rotational force (e.g., the clockwise direction as shown in FIGS. 7-8) to the running belt 16, the running belt 16 causes the front running belt pulleys 62 and the drive shaft 64 to rotate. The key 136 of the one-way bearing 126, which is press fit into the drive pulley 102, cooperates with the keyway 134 formed in the front shaft 64, causing the drive pulley 102 to rotate as a result of the rotation of the front shaft 64. Stated otherwise, the rotational force of the front shaft 64 is transferred to the drive pulley 102 by the interaction of the keyway 134 and the key 136 of the one-way bearing 126, causing the drive pulley 102 to rotate.

As a user drives the treadmill 10, the generator 106 develops inertia. This inertia is desirably accommodated when a user of the treadmill 10 slows down or stops. The one-way bearing 126 is used to accommodate this inertia in the exemplary embodiment shown. The outer ring 128 of the one-way bearing 126 is rotatable in a clockwise direction (as seen in FIGS. 7-8) independent of the inner ring 130. As the user located on the running belt 16 slows, the front shaft 64 slows. Despite the slowing of the front shaft 64, the one-way bearing 126 allows the drive pulley 102 and elements mechanically coupled thereto, the power transfer belt 104 and the generator 106, to continue rotating until, as a result of friction and gravity, the rotation (or lack thereof) of the running belt 16 matches the rotation of the drive pulley 102, power transfer belt 104, generator input shaft 118 and internal elements of the generator 106 coupled thereto. In this way, the one-way bearing helps prevent the generator 106 from being damaged by the user stopping too quickly and/or the preventing a loss of user control over the speeding up and slowing down of the treadmill 10.

Figure 9:
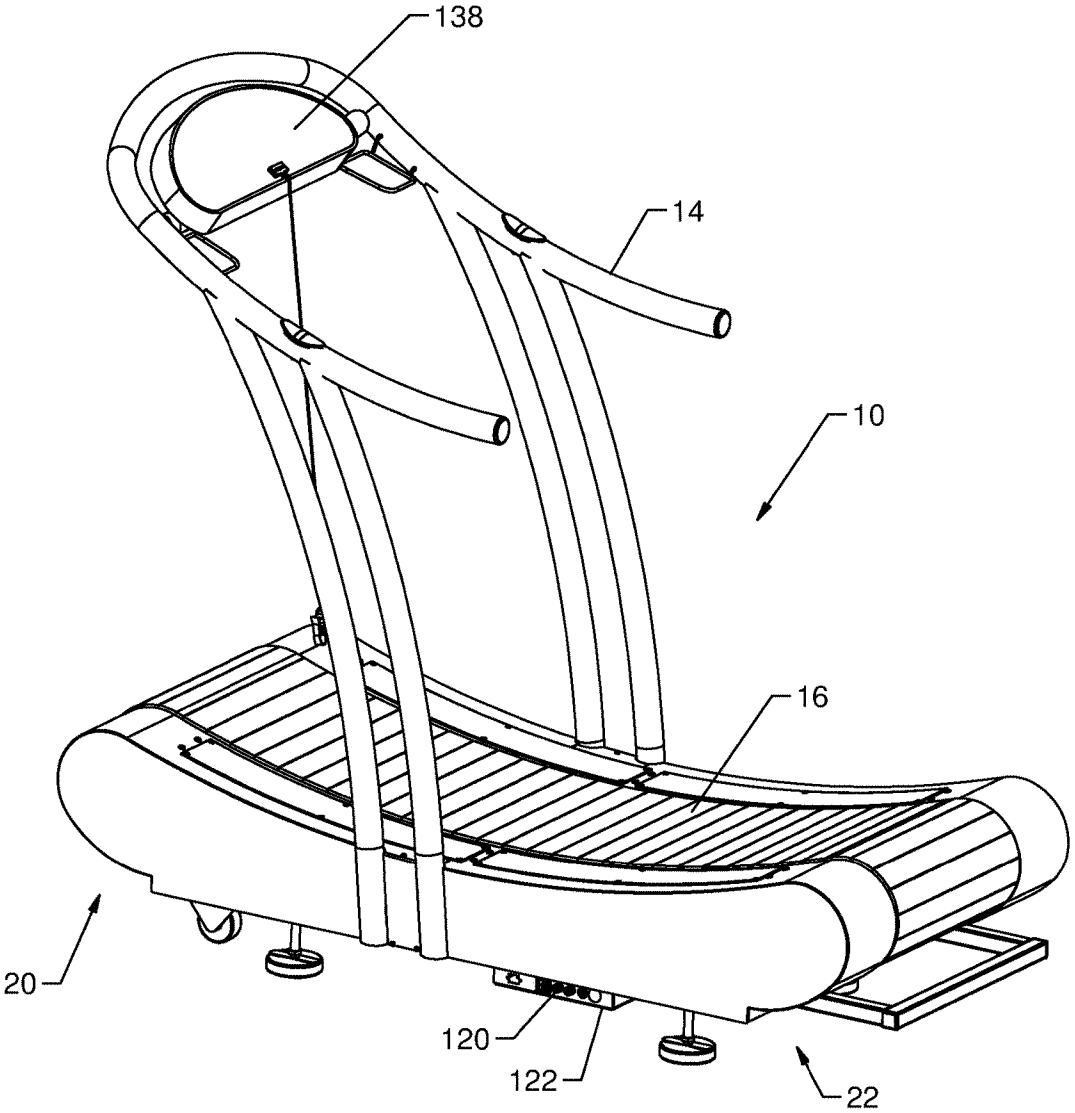
FIG. 9 is perspective view of the manual treadmill according to the exemplary embodiment shown in FIG. 7.

In the exemplary embodiment shown in FIGS. 8 and 9, the battery 108 is electrically interconnected with a display 138 by a conventional electrical wire, providing power thereto during operation of the treadmill 10. The generator control board 110 interfaces with the generator 106 and the display 138 in order to regulate the power provided to the display 138 and/or other electrically-operable devices coupled to the generator 106. The display 138 is configured to provide the performance-related data to the user in a user-readable format which may include, but is not limited to, operation time, current speed, calories burned, power expended, maximum speed, average speed, heart rate, etc.

According to an exemplary embodiment, the display 138 cooperates with the power generation system 100 to allow a user to enter and establish a maximum speed. For example, a user may enter a maximum speed of 5 mph using the controls of the display 138. The information regarding the maximum speed is provided by the control board of the display 138 to the generator control board 110. When the user reaches 5 mph, a braking system incorporated with the generator 106 will engage and limit the speed at which the running belt 16 can move. In these exemplary embodiments, the braking system of the generator 106 limits the speed at which the running belt 16 can move by controlling the speed at which the input shaft 118 can rotate. In this embodiment, when the generator control board 110 recognizes that the generator 106 is operating at a level that exceeds the level that corresponds to a speed of 5 mph, the generator control board 110 will operably prevent the input shaft 118 from rotating with a rotational velocity that will exceed 5 mph. By controlling the rotational velocity of the input shaft 118, the rotational velocity of the drive pulley 102 can be slowed or limited via the power transfer belt 104, thereby slowing or limiting the rotational speed of the front shaft 64, the front running belt pulley 62, and finally the running belt 16. According to one exemplary embodiment, the braking system incorporated with the generator 106 is an eddy current braking system including one or more magnets. When the generator control board 110 signals the generator 106 that the maximum speed has been exceeded, more voltage is directed from the generator control board 110 to the generator 106, causing the magnets of the eddy current braking system to apply a greater force to the input shaft, making it more difficult to impart rotation thereto.

The one-way bearing 126 is mounted to accommodate this braking system. As noted previously, the one-way bearing 126 freely permits rotation in the clockwise direction as seen in FIGS. 8 and 9 of running belt relative to the drive pulley 102, power transfer belt 104 and generator input shaft 118, but restricts or prevents rotation in the counterclockwise direction as seen in FIGS. 8 and 9 of running belt 16 relative to the drive pulley 102, power transfer belt 104 and generator input shaft 118. So, as a user increases the speed of rotation of the running belt 16, the one-way bearing 126 is engaged so that the speed of rotation of the drive pulley 102, power transfer belt 104 and generator input shaft 118 similarly increase. If the user slows down the speed of rotation before hitting the maximum speed input as noted above, the one-way bearing 126 will disengage or release so that the relative inertia of rotation of the generator 106 along with the drive pulley 102, power transfer belt 104 and generator input shaft 118 will not interfere with the user slowing the speed of rotation of the running belt. However, if the user increases the speed of rotation up to the maximum speed, the braking system integrated into the generator 108 will eventually restrict the rotation of the drive pulley 102, power transfer belt 104 and generator input shaft 118. As the user attempts to increase the speed of rotation of the running belt 16 beyond the maximum speed the brake within the generator 108 will restrict the speed of rotation of the generator input shaft 118 which will in turn translate this speed restriction to the power transfer belt 104 and drive pulley 102. The continued urging of the user to increase the speed of the running belt 16 causes the one-way bearing 126 to remain engaged thereby limiting the speed of rotation of the shaft 64 to that of the drive pulley 102. Once the maximum speed is met, the user will be forced to reduce the speed, otherwise, she will have excess forward velocity.

Figure 10:
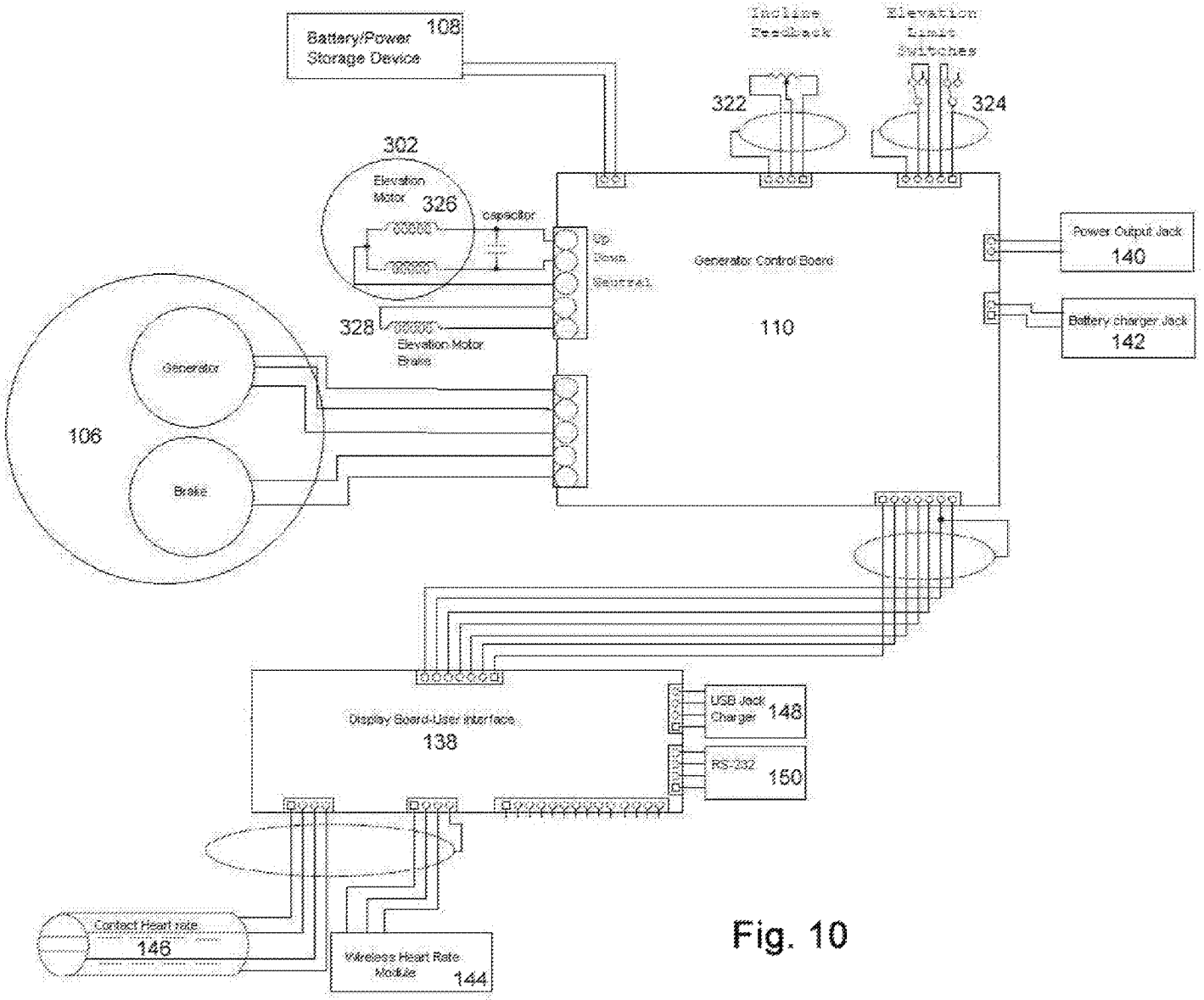
FIG. 10 is a electrical system diagram of the power generation system according to an electrical embodiment.

FIG. 10 provides a system diagram of the power generation system 100. The power generation system 100 is shown including two electrically connected control boards, the generator control board 110 and the control board incorporated with the display 138.

As discussed above, the generator control board 110 electrically connects the generator 106, the battery 108, and the one or more jacks 120. In the exemplary embodiment shown, the jacks 120 include a first jack 140 configured to output DC power to electrically operable devices or equipment and a second jack 142 configured to connect to a charging device suitable for recharging the battery 108 if it is fully discharged.

The control board of the display 138 electrically connects one or more sensors adapted monitor the user's heart rate and one or more jacks or ports for interconnecting electrical devices according to an exemplary embodiment. In the exemplary embodiment shown in FIG. 10, the sensors adapted to monitor the user's heart rate include a first wireless heart monitor 144 that monitors the user's heart rate from a conventional chest strap and a second contact heart monitor 146 that monitors the user's heart rate when the user's hands are positioned on one or more sensor plates or surfaces (e.g., a sensor plate on the handrail 14). The one or more jacks or ports are shown as a USB jack charger 148 configured to connect to and charge any of a variety of devices chargeable via a USB connector and a port shown as an RS-232 port 150, which enables data gathered and stored by the treadmill 10 to be downloaded into a computer.

In the exemplary embodiment shown, the drive pulley 102, the power transfer belt 104, the generator 106, the battery 108, and the generator control board 110 are shown disposed proximate to the left-hand side member 52. In another exemplary embodiment, these components are disposed proximate the outer surface 60 of the right-hand side member 54. According to other exemplary embodiments, one or more of the components may be disposed on opposite sides of the frames 40 and/or at other locations.

Figure 11:
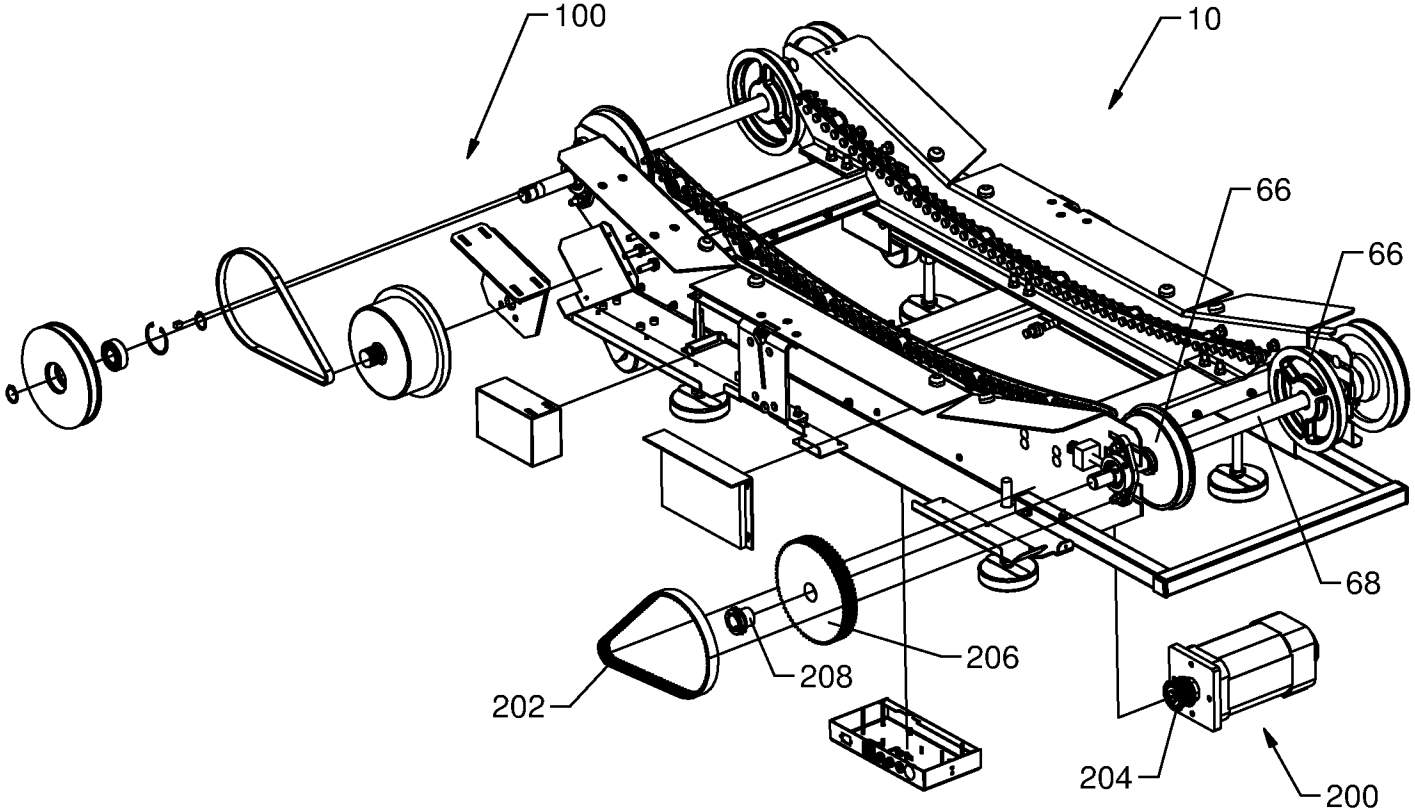
FIG. 11 is a left-hand partially exploded perspective view of a portion of the manual treadmill according to the exemplary embodiment shown in FIG. 1 including a power generation system and a drive motor.

Referring to FIG. 11, a drive motor 200 may be used with or integrated with the power generation system 100 according to an exemplary embodiment. The drive motor 200 is configured to help drive the running belt 16 in certain circumstances. For example, the user may select a setting wherein the running belt 16 is to be maintained at a desired speed and does not rely on the user to drive the running belt 16. In the exemplary embodiment shown, the drive motor 200 does not receive power from the battery 108 in order to operate. Rather, the drive motor that has its own power source that is electrically independent of the power generation system 100. However, in other exemplary embodiments, the drive motor may receive power from a power storage device (e.g., battery 108) of the power generation system in order to operate.

Referring further to FIG. 11, the drive motor 200 is operably coupled to the running belt 16 by a motor belt 202 according to an exemplary embodiment. The motor belt 202 extends about an output shaft 204 of the drive motor 200 and a second drive pulley 206 that is coupled to the rear shaft 68 by a centrally-disposed bushing 208. When the output shaft 204 of the drive motor 200 rotates, it imparts rotational motion to the motor belt 202, which, in turn imparts rotational motion to the second drive pulley 206. The second drive pulley 206, being substantially fixed relative to the rear shaft 68, causes the rear shaft 68 to rotate. The rotation of the rear shaft 68 then causes the rear running belt pulleys 66 and the running belt 16 to rotate.

According to an exemplary embodiment, the treadmill 10 includes two drive motors, one associated with each of the front shaft 64 and the rear shaft 68. Among other applications, the drive motors may be used to control the relative speeds of the front shaft 64 and the rear shaft 68. Typically, the relative speed of the front shaft 64 and the rear shaft 68 is controlled to synchronize the rotational velocities of the shafts.

Figure 12:
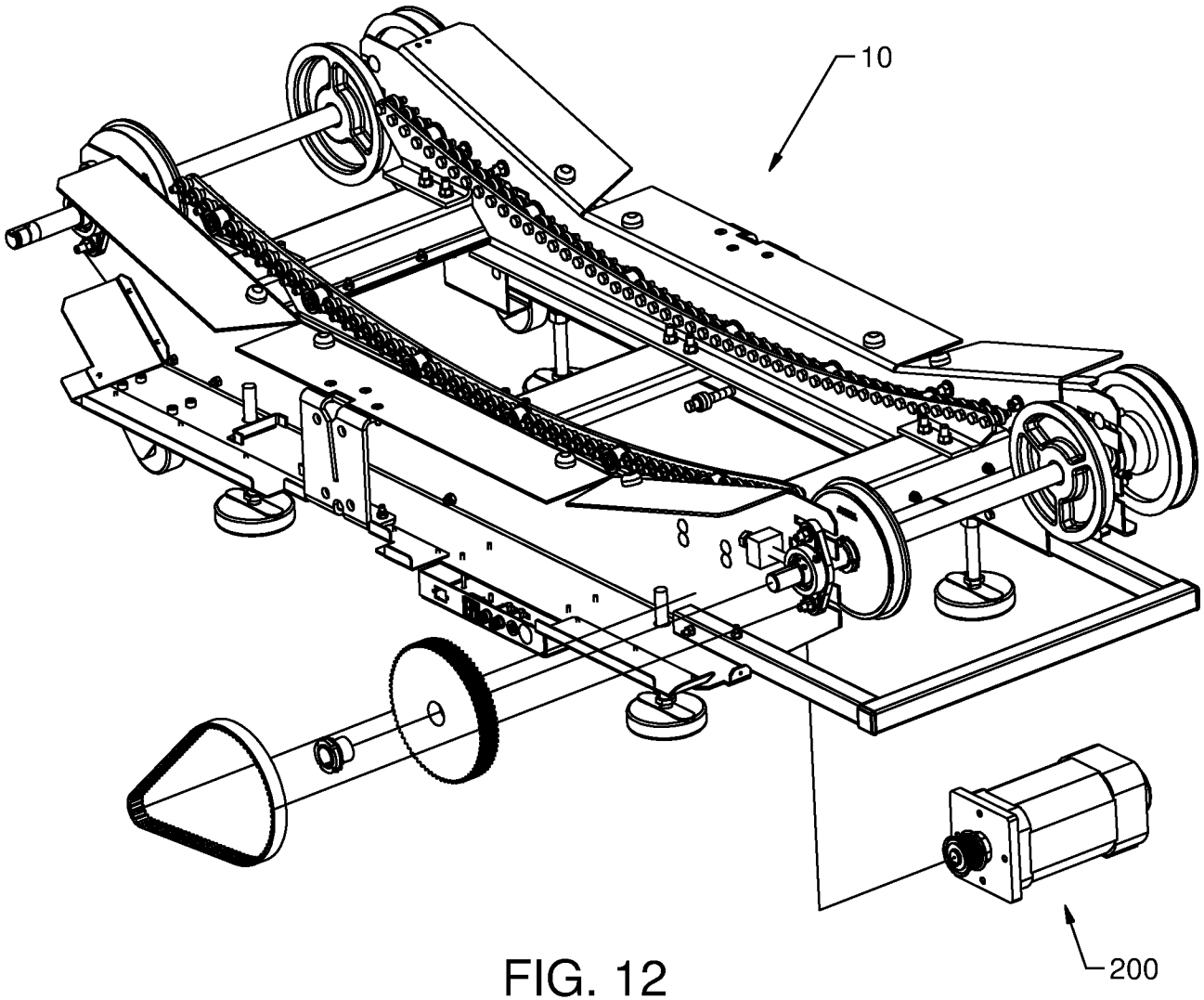
FIG. 12 is a left-hand partially exploded perspective view of a portion of the manual treadmill according to the exemplary embodiment shown in FIG. 1 including a drive motor.

Referring to FIG. 12, the treadmill 10 includes one or more drive motors 200, but does not include a power generation system according to an exemplary embodiment.

Figure 13:
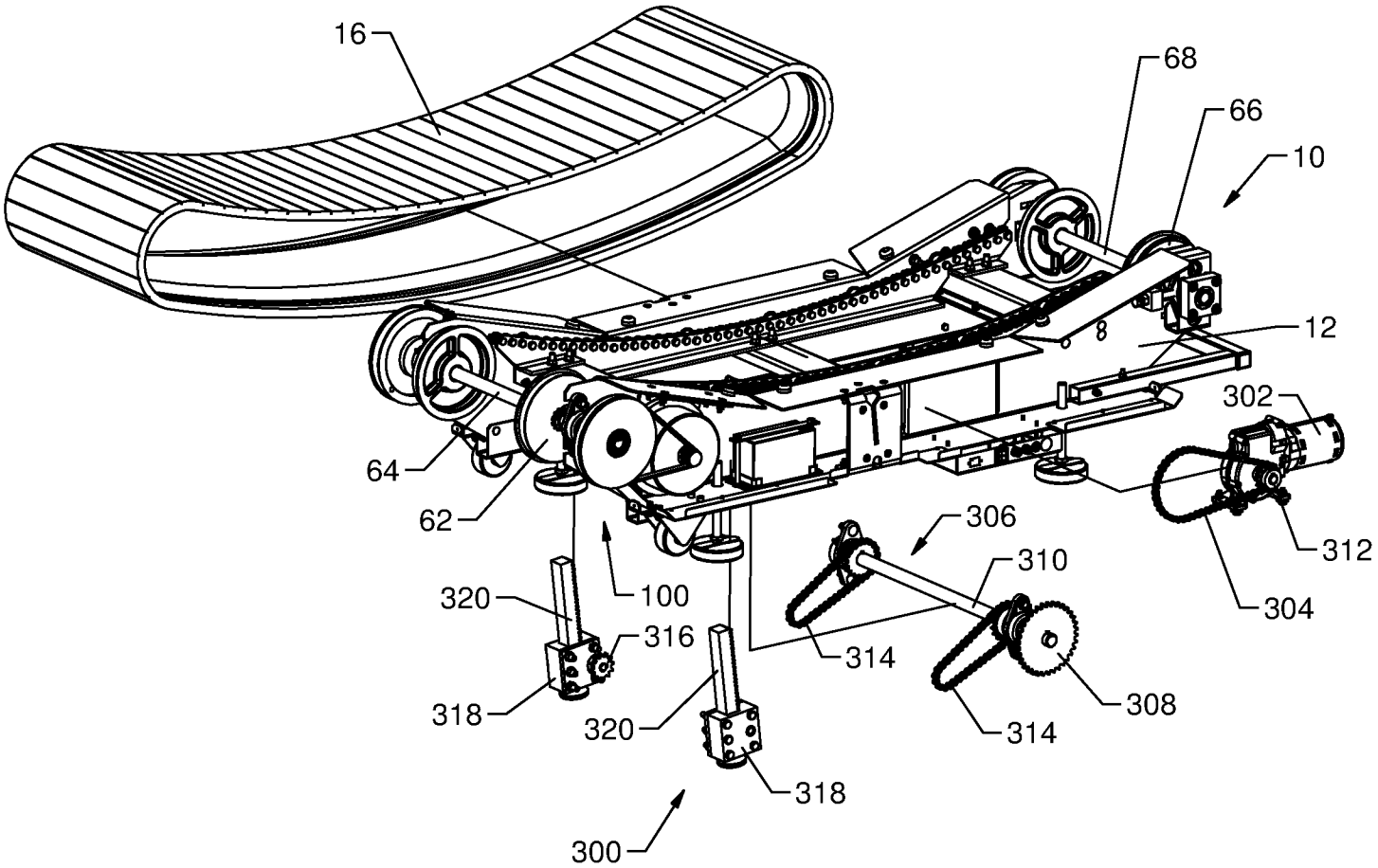
FIG. 13 is a left-hand partially exploded perspective view of a portion of the manual treadmill according to the exemplary embodiment shown in FIG. 1 a motorized elevation adjustment system.

Referring to FIG. 13, the treadmill 10 includes a motor 302 configured to provide power to an elevation adjustment system 300 according to an exemplary embodiment. The motor 302 may be used to alter the incline of the base 12 of the treadmill 10 relative to the ground. The front shaft 64 may be lowered relative to the rear shaft 68 and/or the front shaft 64 may be raised relative to the rear shaft 68 using electrical controls. Further, a user may not have to dismount from the treadmill in order to impart this adjustment. For example, the elevation adjustment system may include controls that are integral with the above-discussed display 134. Alternatively, the controls may be integrated with the handrail 14 or be disposed at another location that is easily accessed by the user when operating the treadmill 10. In some exemplary embodiments, the motor for the elevation adjustment system is at least in-part powered by a power storage device (e.g., battery 108) of the power generation system.

FIG. 13 illustrates a number of components of the exemplary elevation adjustment system 300. When assembled, a drive belt or chain 304 of the drive motor 302 is operably connected to an internal connecting shaft assembly 306 at a sprocket 308. The sprocket 308 is fixed relative to an internal connecting shaft 310 of the internal connecting shaft assembly 306. By imparting rotational motion to the drive belt or chain 304 via an output shaft 312, the drive motor 200 causes the sprocket 308 and the internal connecting shaft 310 to rotate. The internal connecting shaft assembly 306 further includes a pair of drive belts or chains 314 that are operably coupled to gears 316 of rack and pinion blocks 318. The rotation of the internal connecting shaft 310 causes the drive belts or chains 314 to rotate gears 316. As the gears 316 rotate, a pinion (not shown) disposed within the rack and pinion blocks 318 imparts linear motion to the racks 320, thereby operably raising or lowering the base 12 of the treadmill 10 depending on the direction of rotation of the output shaft 312 of the drive motor 302. According to other exemplary embodiments, any suitable linear actuator may serve as an elevation adjustment system for the manual treadmill disclosed herein.

Referring back to FIG. 10, the generator control board 110 also electrically connects components of an elevation adjustment system 300. Specifically, the generator control board 110 electrically connects the motor 302 of the elevation adjustment system 300, an incline feedback system 322 including a potentiometer that is conventional in the art, and one or more elevation limit switches 324 which limit the maximum and minimum elevation of the base 12 of the treadmill by acting as a safety stop. The motor 302 is further shown incorporating a capacitor start module 326 and an electromechanical brake 328, which are also electrically connected to the generator control board 110.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and are considered to be within the scope of the disclosure.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

For the purpose of this disclosure, the term "coupled" means the joining of two members directly or indirectly to one another. Such joining may be stationary or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It should be noted that the orientation of various elements may differ according to other exemplary embodiments, and that such variations are intended to be encompassed by the present disclosure.

It is important to note that the constructions and arrangements of the manual treadmill as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

What is claimed is:

1. A treadmill, comprising:

a treadmill frame having a front end and a rear end opposite the front end;

a front running belt pulley coupled to the treadmill frame at or near the front end;

a rear running belt pulley coupled to the treadmill frame at or near the rear end;

a running belt disposed about the front and rear running belt pulleys, the running belt adapted for rotation about the front and rear running belt pulleys and defining a non-planar running surface;

a brake coupled to the running belt and adapted to selectively restrict the speed of rotation of the running belt depending upon an established limit for the speed of the running belt; and a motion restricting element coupled to the frame and configured to limit the rotation of the running belt to only one direction so that resistance to rotation of the running belt supplied by the brake is applied in only one rotational direction of the running belt, the motion restricting element comprising first and second rings, the first ring being independently movable relative to the second ring.

2. The treadmill of claim 1, further comprising a display coupled to the treadmill frame, the display configured to enable a user to input the established limit for the speed of the running belt.

3. The treadmill of claim 2, wherein in response to the user reaching or exceeding the established limit for the speed, the brake restricts the speed of the running belt.

4. The treadmill of claim 3, wherein the brake is an eddy current brake.

5. The treadmill of claim 4, wherein in response to the user reaching or exceeding the established limit for the speed of the running belt, the eddy current brake uses relatively more voltage to exert a greater force output from the eddy current brake to restrict rotation of the running belt.

6. The treadmill of claim 1, further comprising:

a front shaft coupled to the frame at or near the front end, wherein the front running belt pulley is coupled to the front shaft;

a drive pulley coupled to the front shaft; and a power transfer belt that couples the brake to the drive pulley such that the brake selectively restricts movement of the power transfer belt which restricts rotation of the drive pulley which in turn restricts rotation of the front shaft, front running belt pulley, and the running belt.

7. A manually operated treadmill, comprising:

a treadmill frame;

a running belt coupled to the treadmill frame and adapted for rotation relative to the treadmill frame, the running belt defining a non-planar running surface;

a brake coupled to the treadmill frame and coupled to the running belt and adapted to selectively restrict rotation of the running belt;

a motion restricting element coupled to the frame and configured so that rotational force of the running belt can be transferred to the brake in only one rotational direction of the running belt, the motion restricting element comprising a first ring independently movable relative to a second ring; and a display coupled to the treadmill frame, the display configured to enable a user to set an established limit for the speed of the running belt, wherein in response to the user reaching or exceeding the established limit for the speed of the running belt, the brake restricts rotation of the running belt.

8. The manually operated treadmill of claim 7, further comprising:

a support member coupled to the frame;

a running belt pulley coupled to the support member and at least partially supporting the running belt; and a drive pulley coupled to the support member.

9. The manually operated treadmill of claim 8, further comprising a power transfer belt that couples the drive pulley to the brake.

10. The manually operated treadmill of claim 9, wherein the motion restricting element is a one-way bearing coupled to the support member, wherein the one-way bearing is structured to allow rotational force of the running belt to only be transferred via the drive pulley and power transfer belt to the brake in one rotational direction of the running belt.

11. The manually operated treadmill of claim 7, wherein the brake is an eddy current brake.

12. The manually operated treadmill of claim 7, wherein the non-planar running surface is curved.

13. The manually operated treadmill of claim 7, wherein in response to the user reaching or exceeding the established limit for the speed of the running belt, the brake restricts rotation of a shaft of the brake that is coupled to the running belt from rotating with a velocity that exceeds the established limit for the speed of the running belt.

14. A manually operated treadmill, comprising:

a treadmill frame having a front end and a rear end opposite the front end;

a front shaft coupled to the treadmill frame at or near the front end;

a rear shaft coupled to the treadmill frame at or near the rear end;

a running belt coupled to the treadmill frame, disposed about the front and rear shafts and adapted for rotation relative to the frame, the running belt defining a curved running surface;

a brake coupled to the treadmill frame and to the running belt, the brake adapted to selectively restrict rotation of the running belt in response to a speed of the running belt exceeding an established limit for the speed of the running belt; and a motion restricting element coupled to the frame and configured to limit the rotation of the running belt to only one direction so that resistance to rotation of the running belt supplied by the brake is applied in only one rotational direction of the running belt, the motion restricting element comprising first and second elements, the first element being independently movable relative to the second element.

15. The manually operated treadmill of claim 14, further comprising a display coupled to the treadmill frame, the display configured to enable a user to input the established limit for the speed of the running belt.

16. The manually operated treadmill of claim 15, wherein the brake is an eddy current brake and in response to the user reaching or exceeding the established limit for the speed of the running belt, relatively more voltage is directed to the eddy current brake to cause a greater force output from the eddy current brake to restrict rotation of the running belt.

17. The manually operated treadmill of claim 14, further comprising:

a drive pulley coupled to the front shaft; and a power transfer belt configured to couple the brake to the drive pulley such that the brake selectively restricts movement of the power transfer belt which restricts rotation of the drive pulley which in turn restricts rotation of the front shaft and the running belt.

18. The manually operated treadmill of claim 17, wherein the motion restricting element is a one-way bearing coupled to the front shaft and adapted to permit rotation of the power transfer belt relative to the front shaft only in a single direction of rotation.

19. The manually operated treadmill of claim 14, further comprising an elevation adjustment system structured to alter an incline of at least a portion of the manually operated treadmill relative to a support surface for the manually operated treadmill.

20. A treadmill, comprising:

a frame having a front end and a rear end opposite the front end;

a running belt coupled to the frame and defining a running surface;

a brake coupled to the running belt and adapted to restrict a speed of rotation of the running belt; and a motion restricting element coupled to the frame and configured to selectively transfer rotational force of the running belt to the brake, the motion restricting element comprising a first ring element and a second ring element, wherein the first ring element is independently movable relative to the second ring element;

wherein in response to a speed of the running belt differing from that of the first element of the motion restricting element, the motion restricting element substantially prevents transmission of rotational force of the running belt to the brake.

21. The treadmill of claim 20, wherein in response to the speed of the running belt being less than that of the first ring element, the motion restricting element substantially prevents transmission of rotational force of the running belt to the brake.

22. The treadmill of claim 20, wherein in response to the speed of the running belt substantially matching that of the first ring element, the motion restricting element substantially enables the transfer of rotational force of the running belt to the brake.

23. The treadmill of claim 20, further comprising a front shaft coupled to the treadmill frame at or near the front end, and a rear shaft coupled to the treadmill frame at or near the rear end, wherein in response to the front shaft rotating at a different speed relative to the first ring element of the motion restricting element, the motion restricting element substantially prevents transmission of rotational force of the running belt to the brake.

24. The treadmill of claim 20, wherein the treadmill is a motor-less treadmill.

25. The treadmill of claim 20, wherein the running surface is a curved running surface.

* * * * *